US007789388B2

(12) United States Patent
Matsubara et al.

(10) Patent No.: US 7,789,388 B2
(45) Date of Patent: Sep. 7, 2010

(54) IMAGE FORMING APPARATUS AND SHEET CONVEYING APPARATUS

(75) Inventors: Hideyuki Matsubara, Mishima (JP); Fumiki Inui, Mishima (JP); Kazuhide Kudo, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 11/945,738

(22) Filed: Nov. 27, 2007

(65) Prior Publication Data

US 2008/0296834 A1 Dec. 4, 2008

(30) Foreign Application Priority Data

Jun. 1, 2007 (JP) ..... 2007-146375

(51) Int. Cl.
*B65H 39/10* (2006.01)

(52) U.S. Cl. ..... 271/301; 271/303; 271/291; 271/65; 271/186; 399/364; 399/401; 399/405

(58) Field of Classification Search ..... 271/301, 271/303, 291, 65, 186; 399/364, 401, 405
See application file for complete search history.

(56) References Cited

U.S. PATENT DOCUMENTS

| | | | | |
|---|---|---|---|---|
| 4,735,409 | A * | 4/1988 | Brown | 271/186 |
| 5,225,881 | A * | 7/1993 | Goto et al. | 399/402 |
| 5,235,381 | A | 8/1993 | Namiki et al. | 355/72 |
| 5,253,854 | A | 10/1993 | Tanoue et al. | 271/10 |
| 5,708,954 | A | 1/1998 | Ando et al. | 399/402 |
| 5,974,290 | A | 10/1999 | Inoue | 399/124 |
| 6,078,760 | A | 6/2000 | Abe et al. | 399/45 |
| 6,185,380 | B1 | 2/2001 | Abe et al. | 399/18 |
| 6,186,497 | B1 * | 2/2001 | Johnston | 271/186 |
| 6,328,301 | B1 | 12/2001 | Tsujii et al. | 271/117 |
| 6,340,157 | B1 * | 1/2002 | Watanabe et al. | 271/301 |
| 6,402,133 | B1 * | 6/2002 | Miyake | 271/3.19 |
| 6,578,840 | B1 | 6/2003 | Kudo | 271/10.13 |
| 6,618,577 | B2 * | 9/2003 | Omura | 399/401 |
| 6,669,189 | B2 * | 12/2003 | Seto et al. | 271/186 |
| 6,681,096 | B2 * | 1/2004 | Seto et al. | 399/388 |
| 6,926,272 | B2 * | 8/2005 | Carter et al. | 271/258.01 |
| 6,983,122 | B2 * | 1/2006 | Hayamizu et al. | 399/405 |

(Continued)

FOREIGN PATENT DOCUMENTS

| | | |
|---|---|---|
| JP | 2-66053 | 3/1990 |

(Continued)

*Primary Examiner*—Patrick Mackey
*Assistant Examiner*—Prasad V Gokhale
(74) *Attorney, Agent, or Firm*—Fitzpatrick, Cella, Harper & Scinto

(57) ABSTRACT

A sheet conveying apparatus according to the invention includes a first conveying path; a sheet reverse conveying portion; a second conveying path; a third conveying path; and a movable guide portion configured to guide the conveyed sheet. The guide portion is moved to a position where the sheet can pass when the sheet is guided from the first conveying path to the second conveying path, and the guide portion is moved to a position where the guide portion guides the sheet to the third conveying path while blocking between the first and second conveying paths such that the sheet can not intrude from the second conveying path into the first conveying path when the sheet conveyed by the sheet reverse conveying portion is conveyed in the second direction.

9 Claims, 19 Drawing Sheets

U.S. PATENT DOCUMENTS

| | | | | |
|---|---|---|---|---|
| 7,079,806 | B2 * | 7/2006 | Baek et al. | 399/405 |
| 2001/0036379 | A1 * | 11/2001 | Takahashi et al. | 399/401 |
| 2007/0273092 | A1 | 11/2007 | Inui | 271/251 |
| 2009/0047051 | A1 * | 2/2009 | Suzaki | 399/401 |

FOREIGN PATENT DOCUMENTS

| | | |
|---|---|---|
| JP | 2-75564 | 3/1990 |
| JP | 11-35210 | 2/1999 |
| JP | 11-310356 | 11/1999 |
| JP | 3058720 | 7/2000 |
| JP | 2002-205861 | 7/2002 |
| JP | 2004-292150 | 10/2004 |

* cited by examiner

IMAGE FORMING APPARATUS AND SHEET CONVEYING APPARATUS

BACKGROUND OF THE INVENTION

1. Field of the Invention

The present invention relates to a sheet conveying apparatus which conveys a sheet and an image forming apparatus which forms an image in the sheet.

2. Description of the Related Art

Conventionally, there is known a switchback configuration in which a sheet conveying direction is reversed by switchback. For example, Japanese Patent Application Laid-Open No. 2002-205861 discloses a configuration in which the sheet is guided using a rotatably-supported switching guide plate in performing the switchback conveyance. In the configuration disclosed in Japanese Patent Application Laid-Open No. 2002-205861, the sheet to be conveyed is guided by one surface of the switching guide plate before the switchback is performed, and the sheet is guided to a reverse conveying path by the other surface of the switching guide plate after the switchback. Japanese Patent Application Laid-Open No. 11-310356 discloses a configuration in which the switching guide plate for switching the sheet conveying path is controlled by an actuator.

In the configurations in which the switching guide plate is used as disclosed in Japanese Patent Application Laid-Open Nos. 2002-205861 and 11-310356, after a sheet rear end passes through an end portion of the switching guide plate, the switching guide plate is moved such that the other surface of the switching guide plate guides the sheet, and the switchback of the sheet is performed to introduce the sheet to the reverse conveying path, which results in a long conveying distance for performing the switchback and an enlarged apparatus. In the case where the switching guide plate is controlled using the actuator, the apparatus becomes further enlarged and complicated. Therefore, as disclosed in Japanese Patent Application Laid-Open Nos. 2-66053, 2004-292150, and 2-75564, there is a configuration in which the sheet conveying path is shortened to perform the switchback using a pair of rollers and not the switching guide plate.

The configuration in which the switchback is performed using the pair of rollers will be described with reference to FIG. 10. FIG. 10 is a sectional view illustrating a schematic configuration of a laser beam printer 99 (hereinafter referred to as "apparatus") which is of an example of an image forming apparatus including a conventional sheet conveying apparatus. The apparatus 99 can perform the duplex image formation of the sheet S. The apparatus 99 includes an image forming portion 91, a fixing portion 93, and a sheet reverse conveying portion 92 which is of the sheet conveying apparatus for reversing the sheet to convey the sheet to the image forming portion again.

In the case where the duplex image formation of the sheet S is performed by the apparatus 99, the image formation is performed on one surface of the sheet S by the image forming portion 91, and the sheet S is delivered to the fixing portion 93 to fix the image. Then, the sheet S is conveyed to a pair of reversing rollers 924. The pair of reversing rollers 924 are temporarily stopped when the rear end of the sheet S passes through a first nip N1 between a fixing and discharge roller 921 and a first roller 922. The rear end of the sheet S in which the image formation is completed on one surface is released from constraint between the fixing and discharge roller 921 and the first roller 922, and the sheet S is stopped along an outside of the conveying path by a nip angle of the pair of reversing rollers 924. Then, the reversal rotation of the pair of reversing rollers 924 performs the reverse conveyance of the sheet S to a second nip N2 between the fixing and discharge roller 921 and a second roller 923. Then, the sheet S is conveyed to the image forming portion 91 again by the conveying roller pair 926, and the sheet S is discharged from a discharge roller pair 925 through the fixing portion 93 after the image formation is performed to a backside of the sheet S.

At this point, in order to deal with the case in which the end portion of the sheet S is curled toward the image forming surface side, Japanese Patent No. 3058720 discloses a configuration in which a guide shape is provided to smoothly convey the sheet S to the second nip N2. Japanese Patent Application Laid-Open No. 11-035210 discloses a configuration in which a guide is provided to guide the sheet, reverse after temporarily conveyed into the sheet discharge path, to a return path for conveying the sheet to the image forming portion again. The guide can be moved between a position where the guide is retracted from a sheet discharge path and a position where a front-end portion of the guide protrudes into the sheet discharge path. The sheet is guided to the return path by the guide located at the position where the front-end portion of the guide intrudes in the sheet discharge path.

It is thought that the sheet is curled due to heat and pressure imparted by the fixing portion 93 when passing through the fixing portion 93. In the case where the end portion of the sheet S is curled toward the image forming surface side, sometimes the end portion of the sheet S is headed to the first nip N1, the fixing and discharge roller 921, or the first roller 922 when the sheet S should be conveyed to the second nip N2 by the reversal rotation of the pair of reversing rollers 924. Because the first nip N1 is rotated in a direction in which the sheet S is discharged at that time, conveyance failure is generated to cause damage to the end portion of the sheet. The sheet whose end portion is curled cannot surely be prevented from intruding in the first nip N1 by the guide shape disclosed in Japanese Patent No. 3058720 and the guide, disclosed in Japanese Patent Application Laid-Open No. 11-035210, which is located at the position where the guide intrudes in the sheet discharge path.

SUMMARY OF THE INVENTION

In view of the foregoing, the present invention provides a sheet conveying apparatus which can surely convey the sheet and an image forming apparatus. In accordance with the invention, a sheet conveying apparatus includes a sheet conveying apparatus comprising: a first conveying path configured to guide a sheet conveyed; a sheet reverse conveying portion which conveys a sheet, which has guided by the first conveying path, in a first direction, and thereafter conveys the sheet in a second direction opposite the first direction; a second conveying path configured to guide the sheet conveyed by the reverse conveying portion in the first direction and the second direction; a third conveying path configured to guide the sheet conveyed from the second conveying path in the second direction by the sheet reverse conveying portion; and a guide portion configured to guide the conveyed sheet, the guide portion is movable and is provided between the first conveying path and the second conveying path, the guide portion contacting with an identical surface side of the sheet when the sheet is guided from the first conveying path to the second conveying path and when the sheet is guided from the second conveying path to the third conveying path, wherein the guide portion is moved to a position where the sheet can pass when the sheet is guided from the first conveying path to the second conveying path, and the guide portion is moved to a position where the guide portion guides the sheet to the third conveying path while blocking between the second conveying path and the first conveying path such that the sheet can not intrude from the second conveying path into the first conveying path when the sheet conveyed by the sheet reverse conveying portion is conveyed in the second direction.

According to the invention, the sheet can surely be conveyed in the configuration in which the inverted conveyance of the sheet is performed.

Further features of the present invention will become apparent from the following description of exemplary embodiments (with reference to the attached drawings).

DESCRIPTION OF THE EMBODIMENTS

Exemplary embodiments of the invention will specifically be described below with reference to the drawings. A printer is illustrated as the image forming apparatus by way of example.

First Embodiment

Referring to FIGS. 1 to 6, a laser beam printer (hereinafter referred to as "apparatus main body") will be described as an image forming apparatus including a sheet conveying apparatus according to a first embodiment of the invention.

Figure 1:
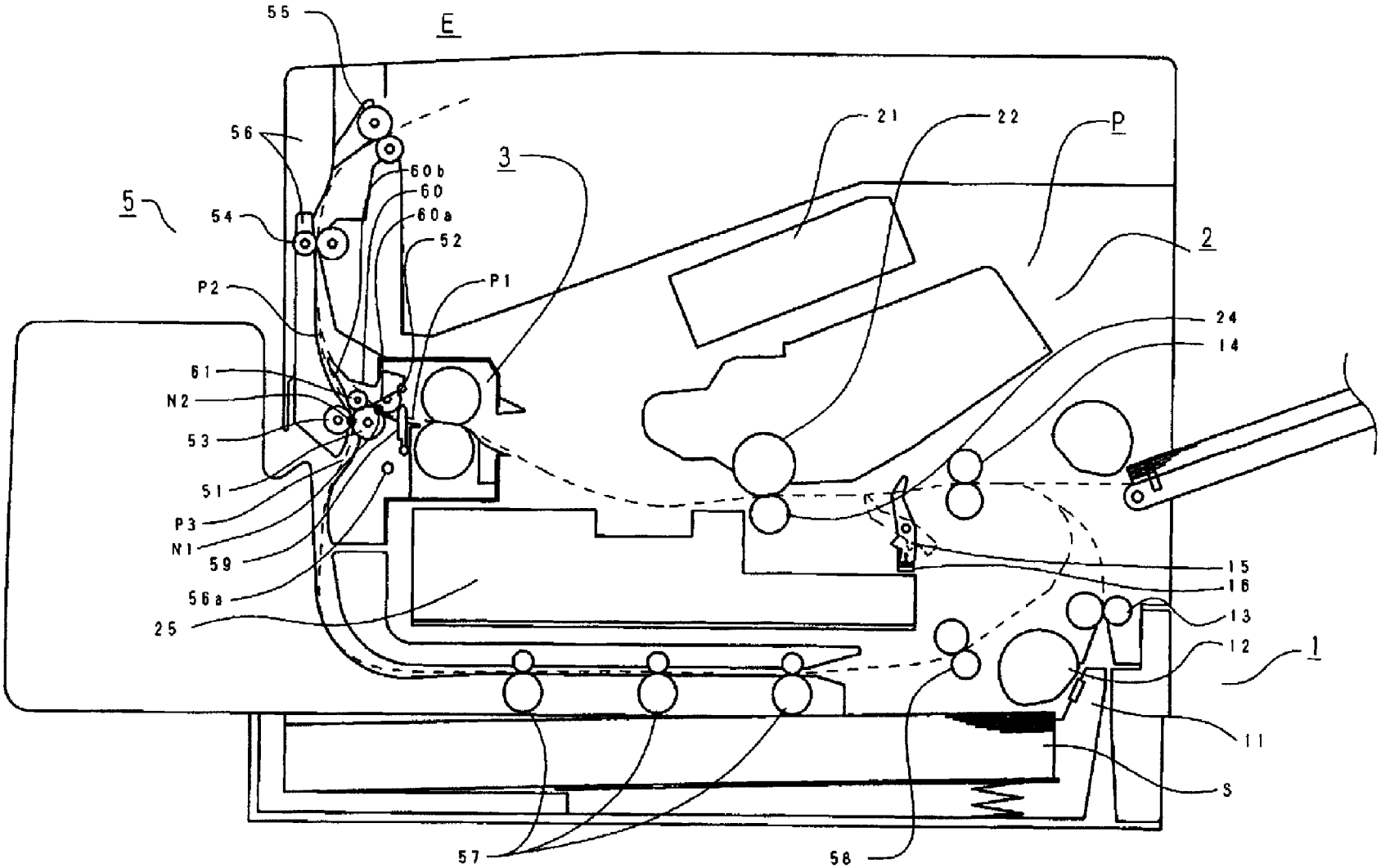
FIG. 1 is a sectional view illustrating a schematic configuration of an image forming apparatus including a sheet conveying apparatus according to a first embodiment of the invention.
Figure 2:
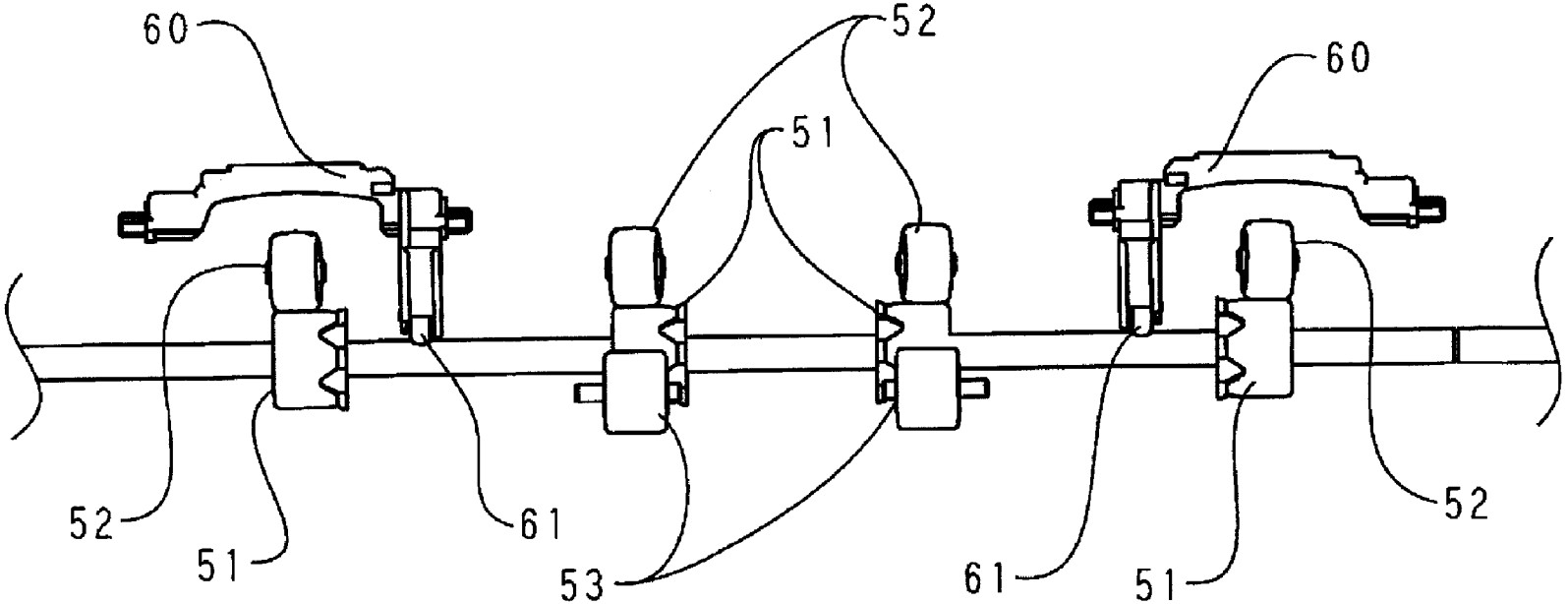
FIG. 2 is a schematic view illustrating a roller configuration and a guide unit in an reverse conveying portion.
Figure 3A:
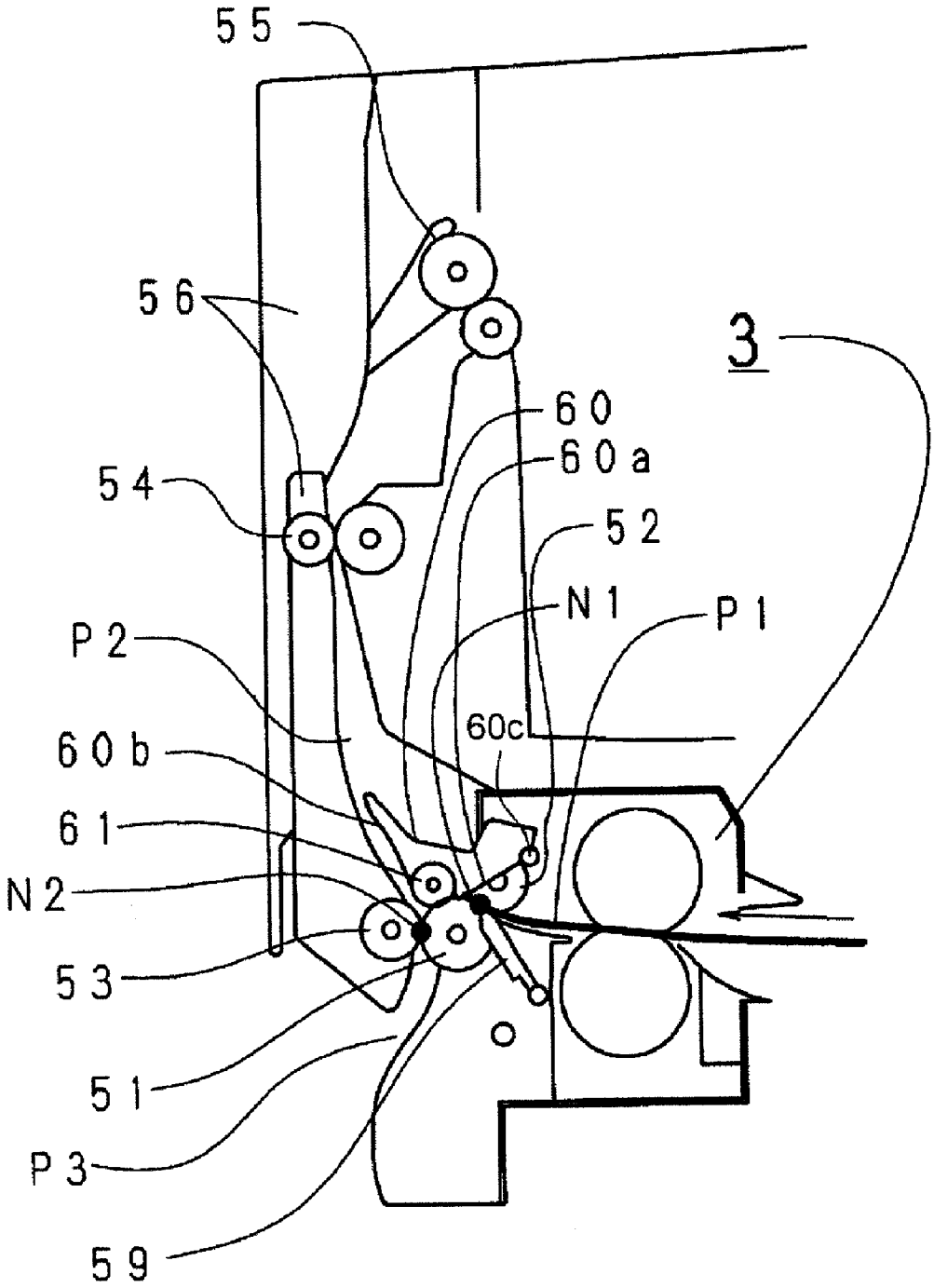
FIG. 3A is a schematic view illustrating a state of the guide unit when a sheet exists in a first conveying path during reverse conveyance of the sheet.
Figure 3B:
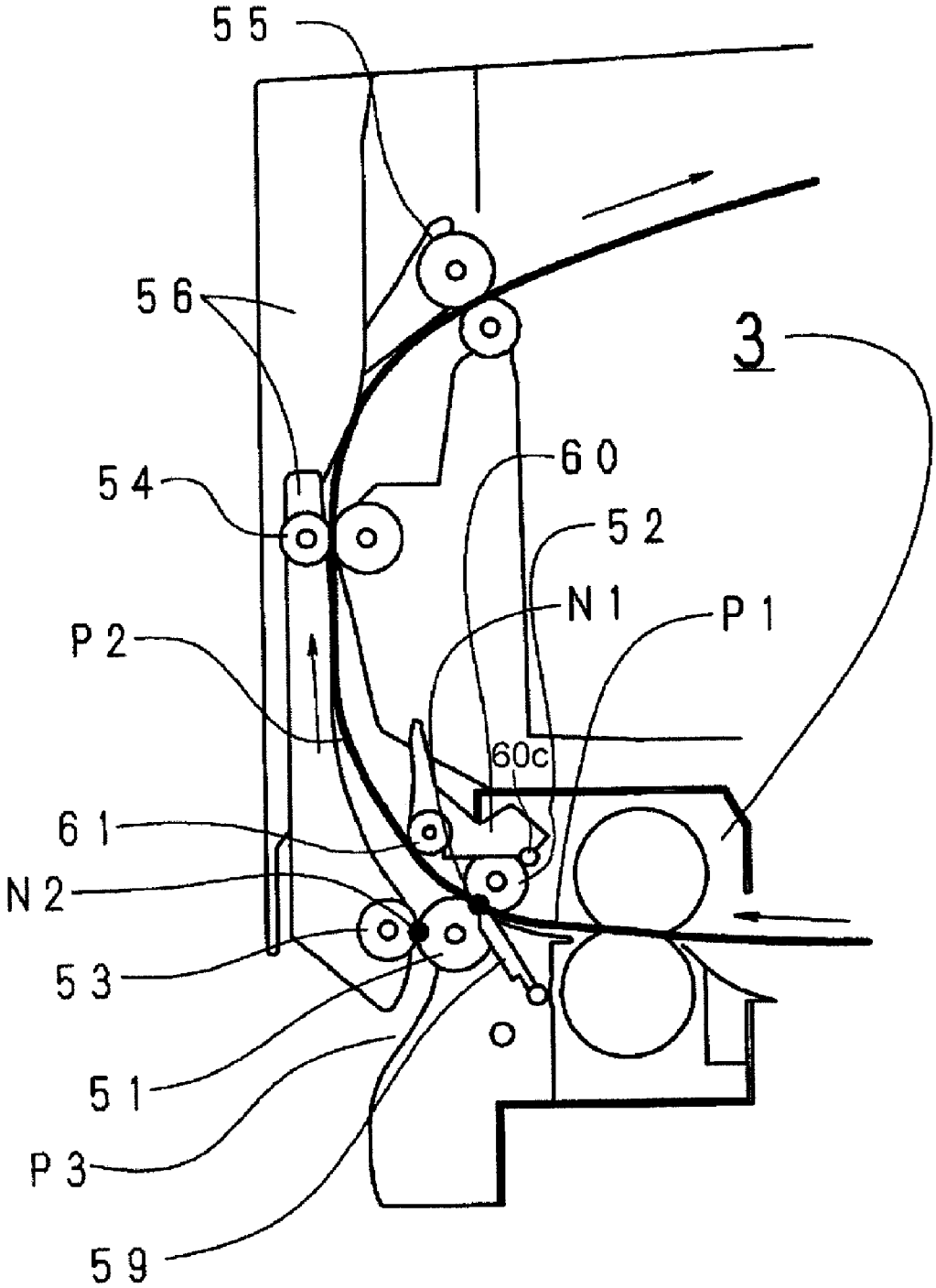
FIG. 3B is a schematic view illustrating a state of the guide unit when the sheet exists in a second conveying path during the reverse conveyance of the sheet.
Figure 3C:
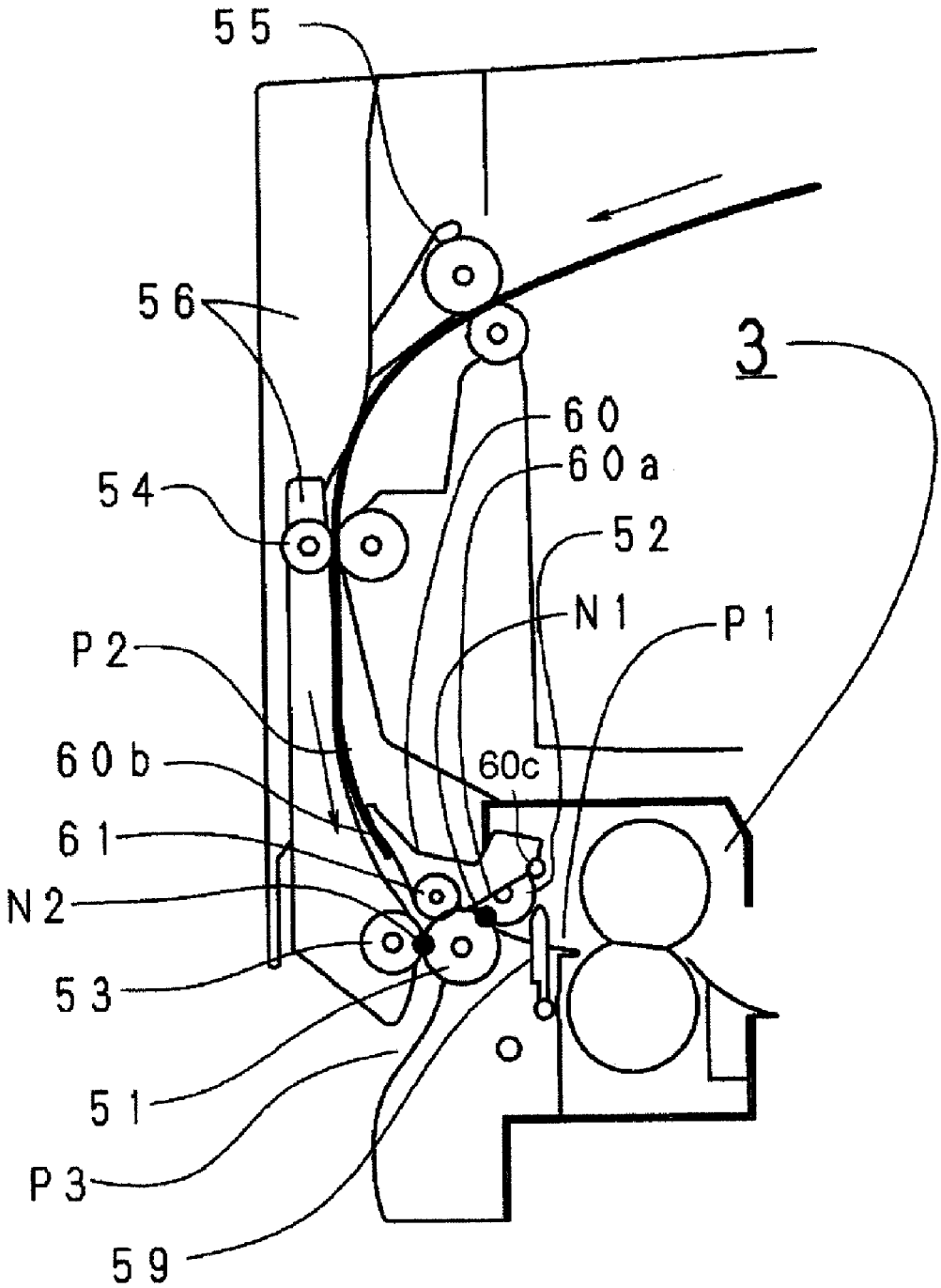
FIG. 3C is a schematic view illustrating a state of the guide unit when the sheet exists in the second conveying path during the reverse conveyance of the sheet.
Figure 4:
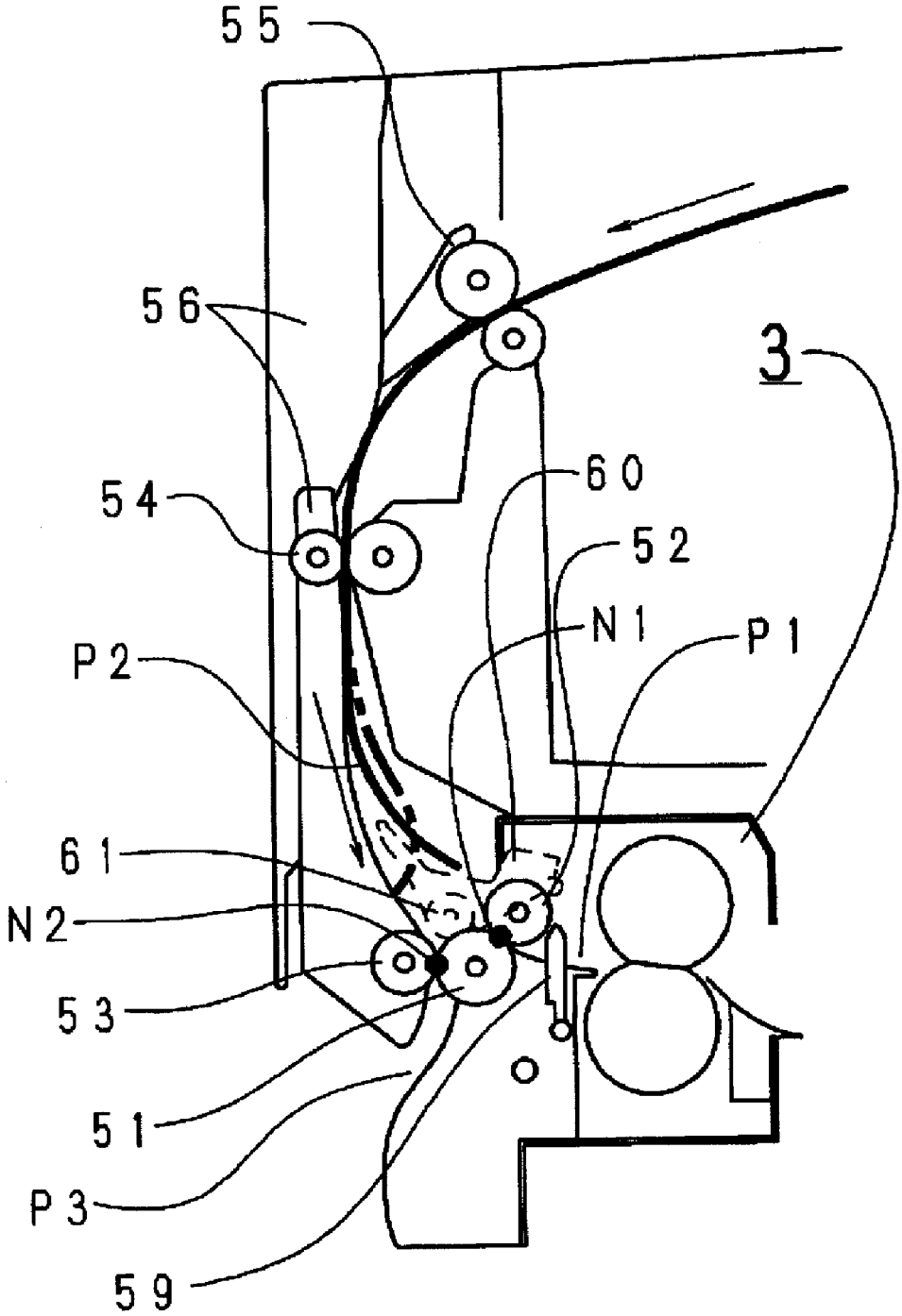
FIG. 4 is a schematic view illustrating a curled state during the reverse conveyance of the sheet.
Figure 5A:
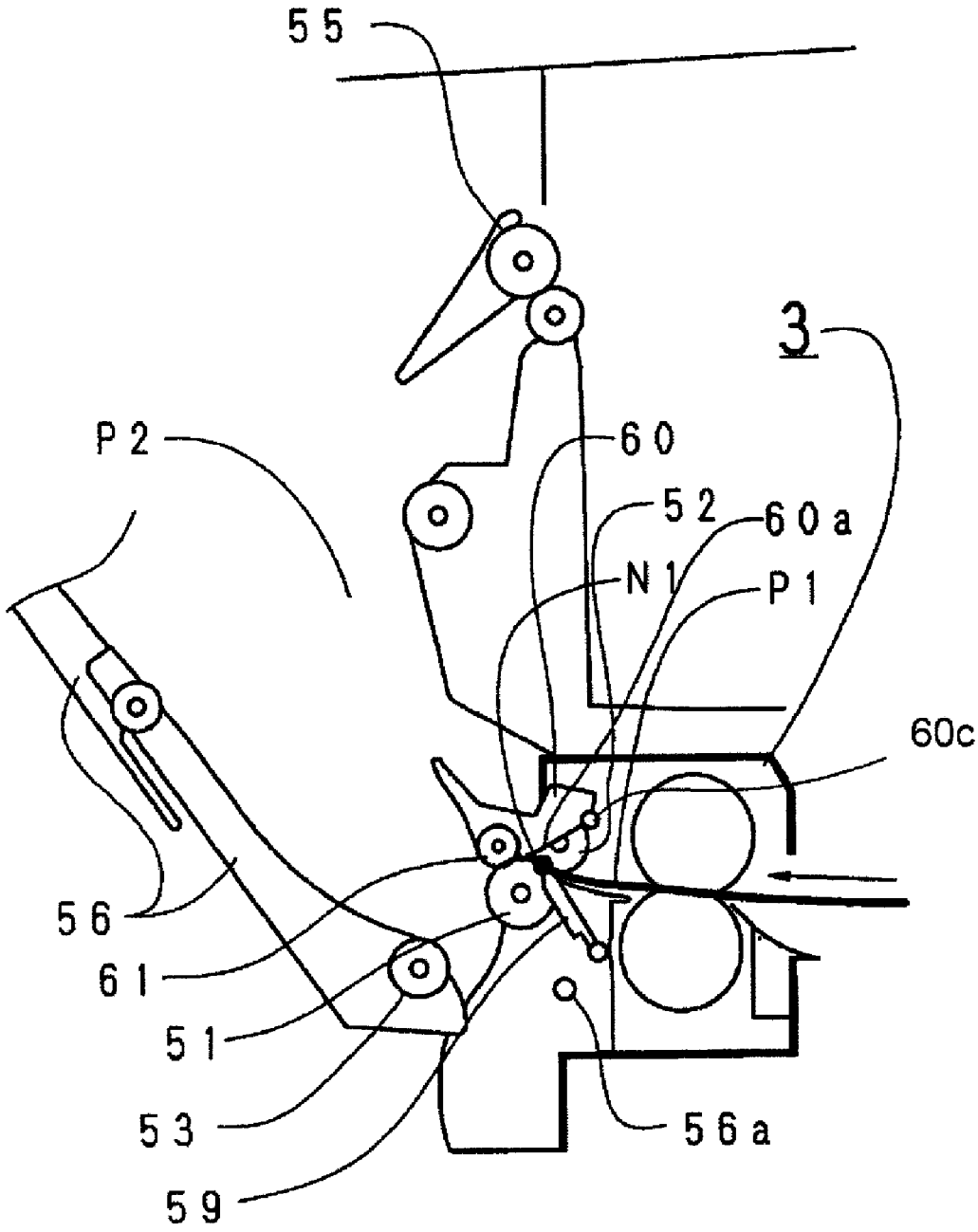
FIG. 5A is a schematic view illustrating a state of the guide unit when the sheet exists in the first conveying path during discharging the sheet with an image forming surface side up.
Figure 5B:
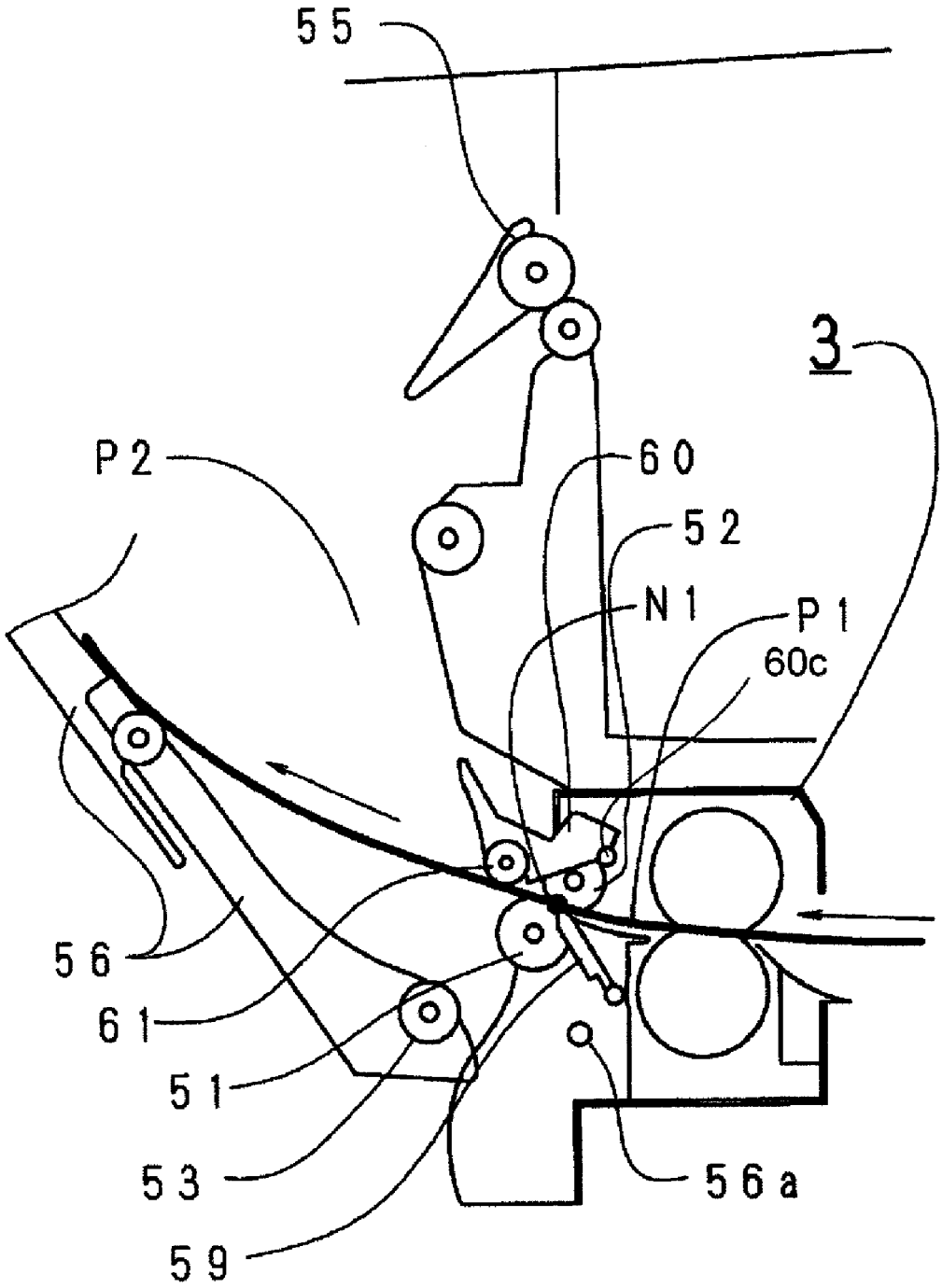
FIG. 5B is a schematic view illustrating a state of the guide unit when the sheet exists in the second conveying path during discharging the sheet with the image forming surface side up.
Figure 5C:
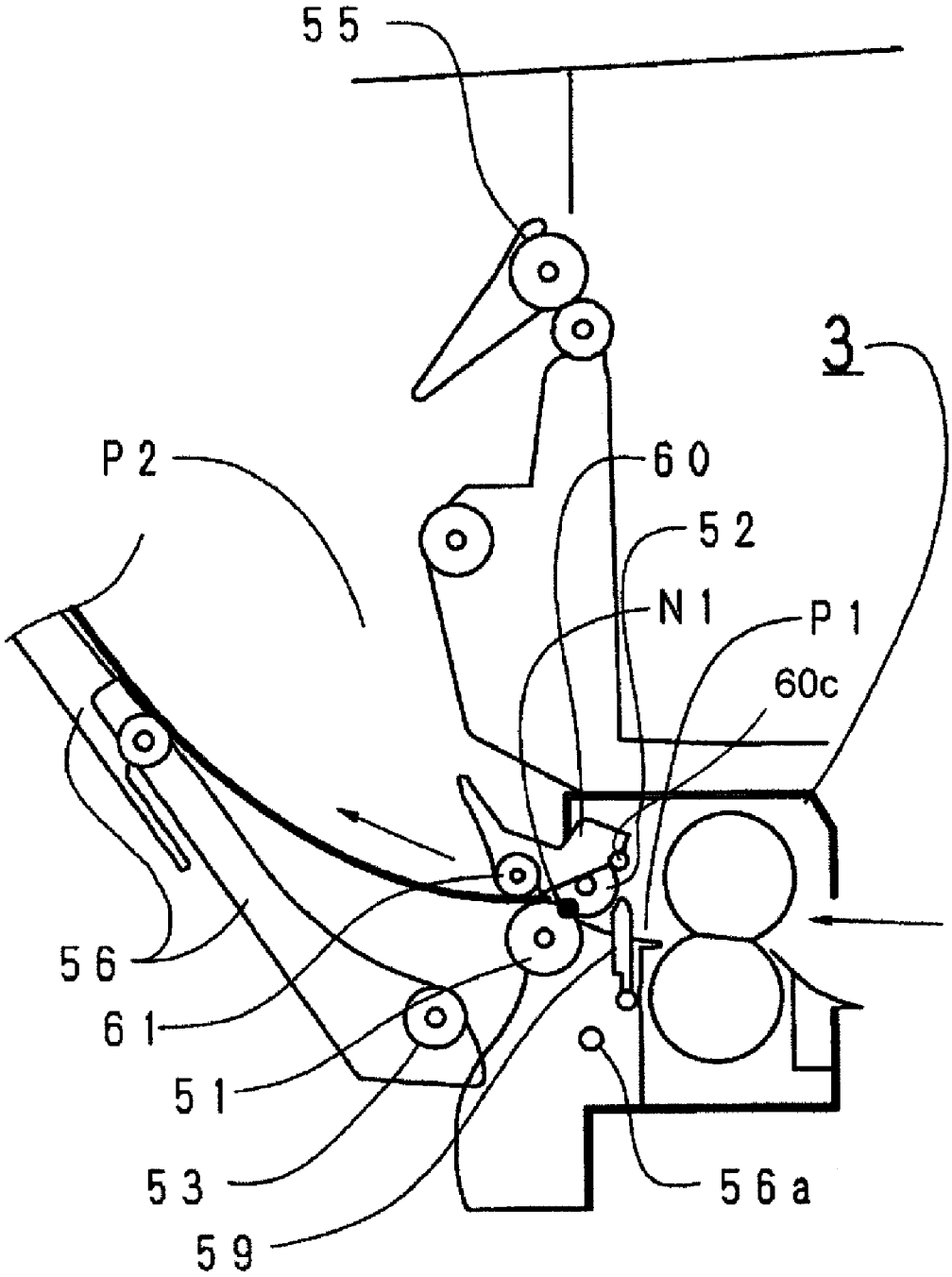
FIG. 5C is a schematic view illustrating a state of the guide unit when the sheet exists in the second conveying path during discharging the sheet with the image forming surface side up.
Figure 5D:
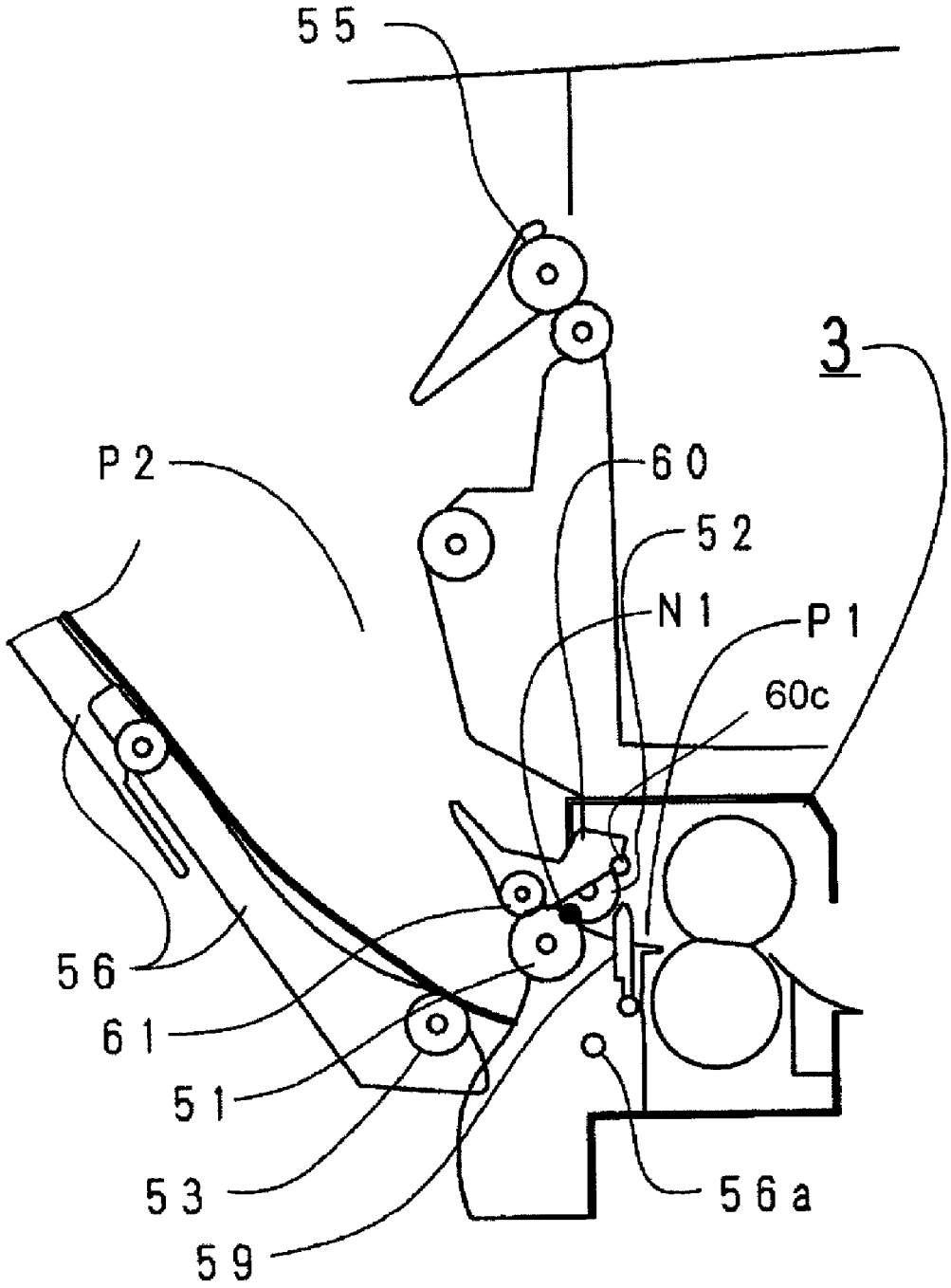
FIG. 5D is a schematic view illustrating a state of the guide unit when the sheet is discharged with the image forming surface side up.
Figure 6:
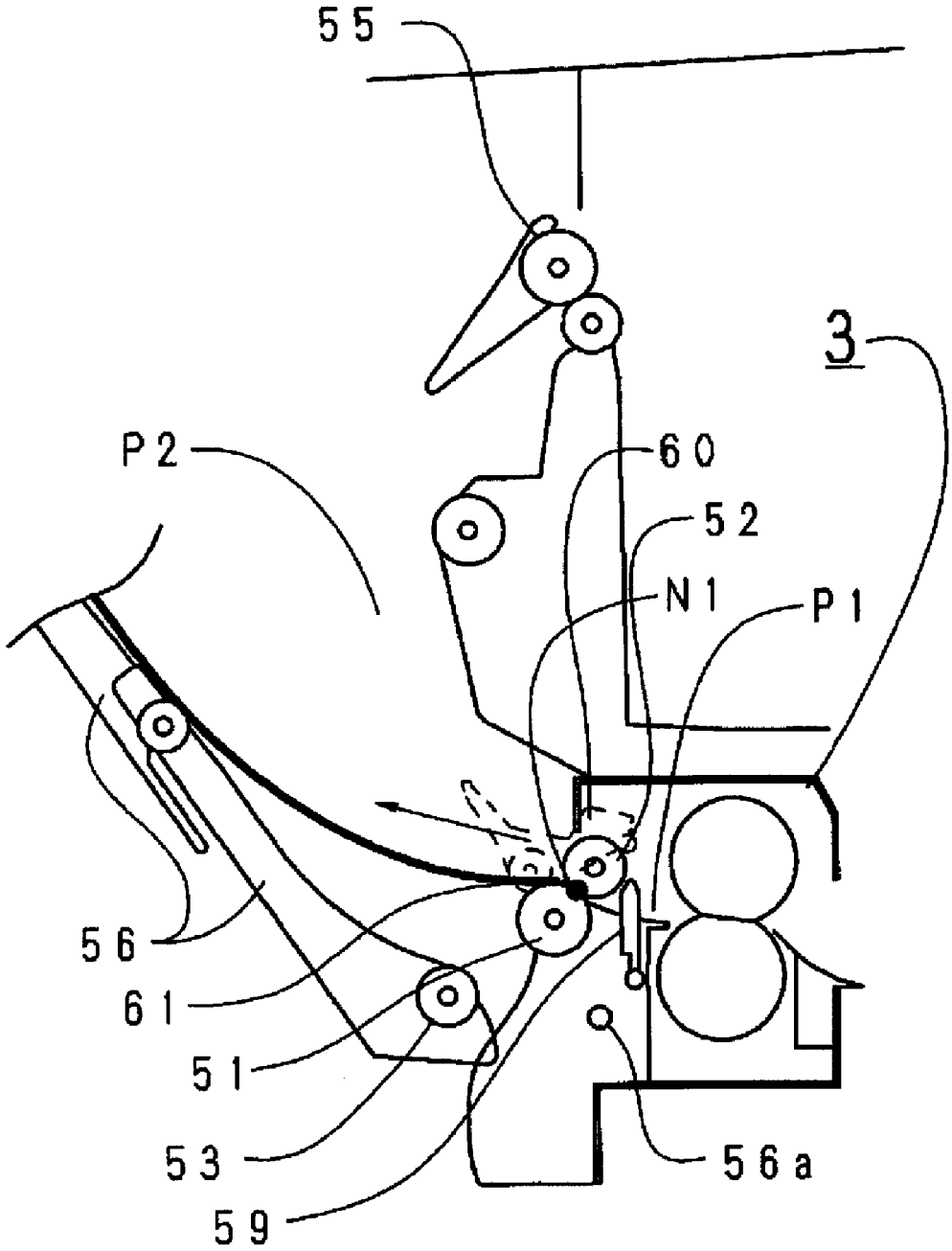
FIG. 6 is a schematic view illustrating a state of the guide unit with the image forming surface side up.

FIG. 1 is a sectional view illustrating a schematic configuration of an image forming apparatus including a sheet conveying apparatus of the first embodiment, and FIG. 2 is a schematic view illustrating a roller configuration and a guide unit in a reverse conveying portion. FIG. 3 is a schematic view illustrating an operation during reverse conveyance of the sheet, and FIG. 4 is a schematic view illustrating a curled state during the reverse conveyance of the sheet. FIG. 5 is a schematic view illustrating a sheet discharge operation with an image forming surface side up, and FIG. 6 is a schematic view illustrating a state of the sheet during discharging the sheet with the image forming surface side up.

(Entire Configuration of Image Forming Apparatus)

Referring to FIG. 1, the schematic configuration of the image forming apparatus will be described along a flow of the sheet S.

An apparatus main body E forms an image by an electrophotographic system. In the apparatus main body E, the sheet S is conveyed to an image forming unit by a feeding and conveying unit, a toner image is transferred to the sheet S, the sheet S is conveyed to a fixing unit to perform toner fixing, and the sheet S is discharged to a disparage portion. Specifically, a cassette 11 in which the sheets S are stacked and stored is loaded into a lower portion of the apparatus. The sheets S stacked and stored in the cassette 11 in a sheet feeding portion 1 are sequentially delivered from the uppermost sheet by a feeding roller 12 rotated counterclockwise, and the sheet S is conveyed to an image forming portion 2 by a pair of conveying rollers 13 and 14.

In the image forming portion 2, a photosensitive drum 22 and a process unit acting on the photosensitive drum 22 are integrally formed in a cartridge P, and the cartridge P is detachably attachable to the apparatus main body E.

A sensor lever 15 and a photo interrupter 16 are provided near the image forming portion 2 to detect the passage of the sheet S. When the sensor lever 15 and the photo interrupter 16 detect the passage of the sheet S, a laser scanner 21 irradiates the photosensitive drum 22 rotated clockwise with a laser beam according to image information after a predetermined time elapses, and an electrostatic latent image is formed on the photosensitive drum 22. The electrostatic latent image is developed with toner in a development portion of the process cartridge P. In the image forming portion 2, a bias voltage is applied to a transfer roller 24 to transfer the toner image to the sheet S as an unfixed image. Then, the sheet S is conveyed to a fixing portion 3. After a fixing process is performed to the sheet S by the fixing portion 3, the sheet S is conveyed and discharged by a discharge roller pair 55. In the apparatus main body E, a discharge tray 56 can be opened to discharge the sheet S to the outside of the apparatus. In FIG. 1, an electric portion 25 has a power supply portion of the apparatus and a control board which controls the apparatus.

In the duplex image formation of the sheet, the switchback of the sheet S is performed after the sheet S passes through the fixing portion 3 to form the image on a first surface (surface) side. The sheet S is conveyed to the image forming portion 2 again by a pair of conveying rollers 57 and 58, the image is formed on a second surface (backside) side of the sheet S, and the sheet S is discharged.

(Configuration of Sheet Reverse Conveying Portion and Neighborhood Thereof)

The configuration of the sheet reverse conveying portion 5 and a neighborhood thereof will be described with reference to FIGS. 1 and 2.

A sheet conveying unit is provided to convey the sheet in which the image is fixed by the fixing portion 3. Specifically, a fixing and discharge roller 51 is disposed on a downstream side of the fixing portion 3 in a sheet conveying direction, and the fixing and discharge roller 51 is rotated in a predetermined direction in which the sheet S is conveyed. A first roller (second rotating member) 52 is provided so as to pressure-contact with the fixing and discharge roller (first rotating member) 51, and the first roller 52 and the fixing and discharge roller 51 convey the sheet S to a pair of reversing rollers 54 while nipping the sheet S therebetween. A second roller (third rotating member) 53 is also provided so as to pressure-contact with the fixing and discharge roller 51, and the second roller 53 and the fixing and discharge roller 51 convey the sheet S to the pairs of conveying rollers 57 and 58 while nipping the sheet S therebetween. The second roller 53 is disposed on the downstream side of an abutting position of the first roller 52 in a rotating direction of the fixing and discharge roller 51.

The conveying path through which the sheet is conveyed is referred to as follows: A conveying path from the image forming portion 2 to a first nip N1 between the fixing and discharge roller 51 and the first roller 52 is referred to as first conveying path P1. A conveying path from the first nip N1 to a second nip N2 between the fixing and discharge roller 51 and the second roller 53 through the pair of discharge rollers 55 is referred to as second conveying path P2. That is, through the second conveying path P2, in order to discharge the sheet conveyed from the first conveying path P1 or to convey the sheet to the image forming portion again, the sheet is conveyed while reversed by the pair of reversing rollers 54 and the pair of discharge rollers 55. A conveying path from the second nip N2 to the pair of conveying rollers 58 is referred to as third conveying path P3. The sheet reversed by the second conveying path P2 is conveyed to the image forming portion through the third conveying path P3.

In the first conveying path P1, a fixing sensor 59 is provided on the downstream side of the fixing portion 3 in the sheet conveying direction to detect the presence or absence of the sheet S.

A guide member 60 constituting a guide unit is swingably provided. A swing center 60*c* of the guide member 60 is located outside a sheet conveying region and on an upstream side in the sheet conveying direction of a branch position between the first conveying path P1 and the second conveying path P2. The guide member 60 can be swung and moved between an interrupt position where the conveying path is interrupted in a range of the first conveying path P1 to the second conveying path P2 and a retracted position where the guide member 60 is retracted from the interrupt position to be able to convey the sheet. When the guide member 60 is located at the interrupt position, the guide member 60 guides the sheet to the second nip N2 using a guide surface 60*b*. When the guide member 60 is located at the interrupt position, the guide member 60 blocks the first nip N1 to prevent the sheet from intruding from the second conveying path P2 to the first conveying path P1.

In the guide member 60, a guide roller 61 is rotatably provided in an abutting portion in which the sheet S abuts on the guide member 60. The guide roller 61 has a relatively large contact angle, and the guide roller 61 is made of polyacetal or a fluorocarbon resin. A sheet front-end abutting surface 60*a* is located near the first nip N1 to smoothly guide the front end of the sheet S to the guide roller 61.

The guide member 60 is swingably supported while having the swing center 60*c*. The swing center 60*c* is located outside the first conveying path P1 and on the upstream side in the sheet conveying direction of the first nip N1 which is of the branch position between the first conveying path P1 and the second conveying path P2. When the sheet S is conveyed from the first conveying path P1 to the second conveying path P2, the guide member 60 is pressed by the front end of the conveyed sheet S, and the guide member 60 is swung clockwise and retracted from the conveying path. When the contact between the sheet S and the guide roller 61 is eliminated, the guide member 60 is swung counterclockwise by a self weight, and the guide member 60 is located at the interrupt position where the guide member 60 interrupts the first conveying path P1 and the second conveying path P2.

A sheet reverse conveying unit is provided on the downstream side of the fixing and discharge roller 51 in the sheet conveying direction to be able to convey the sheet in a discharge direction (first direction) and a direction (second direction) opposite the discharge direction. Specifically, the pair of reversing rollers 54 and the pair of discharge rollers 55 are provided in the second conveying path P2 while being rotatable in both the normal and reversal rotating directions, and the discharge and reverse conveyance of the sheet S conveyed through the second conveying path P2 are performed by the pairs of rollers. Driving units (not shown) are also provided in the sheet reverse conveying portion 5 to normally or reversely rotate the pair of reversing rollers 54 and the pair of discharge rollers 55.

The conveying rollers 57 and 58 located in the third conveying path P3 convey the sheet S, in which the image is already formed in one of the surfaces, to the image forming portion 2 again. A discharge tray 56 is rotated about a rotating center 56*a* to be able to open the second conveying path P2, and the sheet S can be discharged with the image forming surface side up.

The guide member 60 is provided near a roller portion of the fixing and discharge roller 51. The guide member 60 is caused to abut on a rotation abutting portion (not shown) by the self weight, which sets the guide member 60 to an initial position. In discharging the sheet S, the guide member 60 abuts on the position where the nip conveyance of the sheet S can be performed between the guide roller 61 and the fixing and discharge roller 51 while the discharge tray 56 is opened.

(Reverse Conveyance of Sheet)

An operation during the reverse conveyance of the sheet in the configuration of the first embodiment will be described with reference to FIGS. 3 and 4.

In the duplex image formation of the sheet S, the sheet S is guided to the first nip N1 after conveyed through the first conveying path P1 to perform the image formation and the fixing to one of the surfaces. At this point, the fixing sensor 59 detects the front end of the sheet S. The front-end portion of the sheet S abuts on the sheet front-end abutting surface 60*a* of the guide member 60 to rotate the guide member 60 clockwise, thereby retracting the guide member 60 from the conveying path (FIG. 3A). The swing center 60*c* of the guide member 60 is located on the upstream side of the first nip N1 in the sheet conveying direction, and only a force of the self weight is applied to the guide member 60. Therefore, the damage is not caused to the end portion of the sheet S when the front end of the sheet S abuts on the sheet front-end abutting surface 60*a*. Then, the front end of the sheet S is smoothly guided from the sheet front-end abutting surface 60*a* to the guide roller 61.

The guide roller 61 of the guide member 60 abuts on the image forming surface of the sheet S while the sheet S is conveyed to the second conveying path P2 by the fixing and discharge roller 51 and the first roller 52. However, the damage is not caused to the image in the sheet S because not only the guide roller 61 is rotated but also the guide member 60 can be retracted by the sheet S (FIG. 3B). The damage is not caused to the image in the sheet S, even if a conveying speed of the reversing roller 54 is faster than a conveying speed of the fixing and discharge roller 51 to eliminate sheet looseness between the rollers.

Then, after a predetermined time elapses from when the rear end of the sheet S passes through the fixing sensor 59, the reversal rotations of the pair of reversing rollers 54 and pair of discharge rollers 55 are started to guide the sheet S to the second nip N2 and the third conveying path P3. The guide member 60 is rotated counterclockwise to return to the initial position by the self weight immediately after the rear end of the sheet S passes through the first nip N1. At this point, the guide member 60 and the guide roller 61 block the first conveying path P1. At the same time, the guide member 60 is located at the position where the guide surface 60*b* guides the rear end of the sheet S to the second nip N2.

Thus, because the reversing roller 54 can reverse the sheet conveying direction immediately after the rear end of the sheet S passes through the first nip N1, the conveying path can be shortened to achieve the downsizing and speed enhancement of the apparatus. The reverse conveyance of the sheet is controlled so as to be started at the position where the rear end of the sheet S does not exceed the lowermost position of the guide member 60, i.e., the position where the rear end of the sheet S and the guide surface 60*b* surely contact each other.

In the case where the rear end of the sheet S is curled by the influence of the fixing portion 3 in starting the reverse conveyance as shown by a solid line or an alternate long and two short dashes line in FIG. 4, the guide surface 60*b* can apply the force to the end portion of the sheet S. In the case where the guide member 60 does not perfectly return to the initial position due to the large curl amount, the guide member 60 is rotated in the reverse conveyance direction (arrow direction of FIG. 3*c*) by frictional resistance between the sheet S and the guide surface 60*b* when the reverse conveyance is started. This enables the guide member 60 to return to the interrupt position which is of the initial position to guide the rear end of the sheet S to the second nip N2. In such cases, the guide surface 60*b* always guides the end portion of the sheet S. The sheet guide surfaces of the guide surface 60*b* and guide roller 61 smoothly guide the sheet S to the neighborhood of the second nip N2.

Figure 3D:
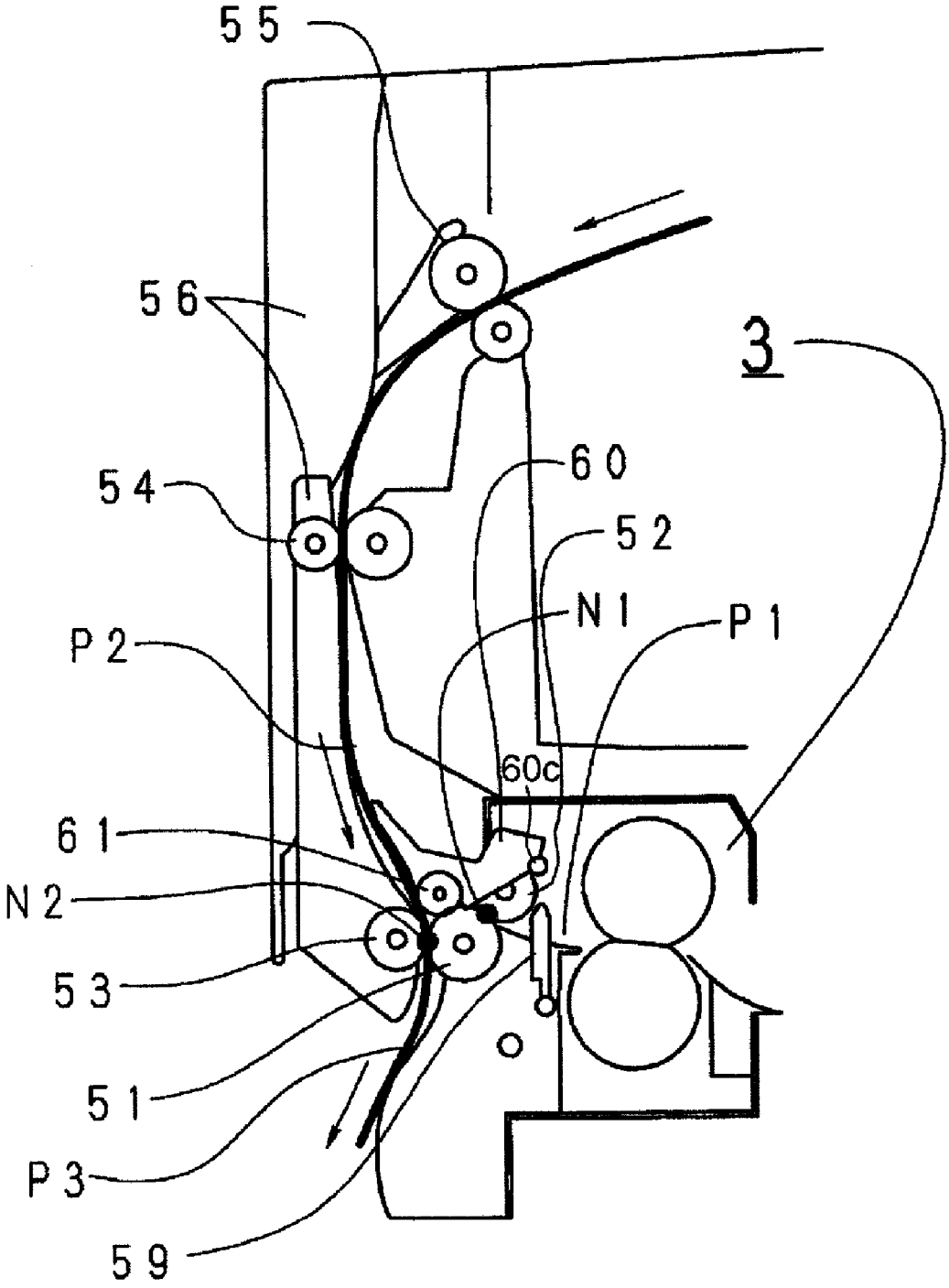
FIG. 3D is a schematic view illustrating a state of the guide unit when the sheet exists in a third conveying path during the reverse conveyance of the sheet.

As a result, during the reverse conveyance, even the sheet S curled toward the image forming surface side or the non-image forming surface side is conveyed to the side of the first conveying path P1, and the sheet S is conveyed from the second nip N2 to the third conveying path P3 without generating the conveyance failure (FIG. 3D). The damage due to the abutment of the end portion of the sheet S on the fixing and discharge roller 51 is not caused to the sheet S, the sheet S is guided surely and smoothly to the second nip N2, and the sheet S can be conveyed to the image forming portion 2 again.

(Discharging Sheet with Image Forming Surface Side Up)

The sheet discharge operation with the image forming surface side up in the configuration of the first embodiment will be described below with reference to FIGS. 5 and 6.

When the sheet S is discharged with the image forming surface side up after the image is formed only in the surface of the sheet S, the discharge tray 56 is rotated about the rotating center 56*a* to open the second conveying path P2, whereby the sheet S is put into the state in which the sheet S can be discharged with the image forming surface side up.

The sheet S is guided to the first nip N1 after the sheet S is conveyed through the first conveying path P1 to perform the image formation and the fixing operation on one of the surfaces of the sheet S. At this point, the fixing sensor 59 detects the front end of the sheet S. The front end portion of the sheet S abuts on the sheet front-end abutting surface 60*a* of the guide member 60 to rotate the guide member 60 clockwise, thereby retracting the guide member 60 from the conveying path (FIG. 5A). The swing center 60*c* of the guide member 60 is located on the upstream side of the first nip N1 in the sheet conveying direction, and only the force of the self weight is applied to the guide member 60. Therefore, damage is not caused to the front end of the sheet S when the front end of the sheet S abuts on the sheet front-end abutting surface 60*a*. Then, the front end of the sheet S is smoothly guided from the sheet front-end abutting surface 60*a* to the guide roller 61, and the sheet S is conveyed to a sheet stacking surface of the discharge tray 56.

The guide roller 61 of the guide member 60 abuts the image forming surface of the sheet S while the sheet S is conveyed to the sheet stacking surface of the discharge tray 56 by the fixing and discharge roller 51 and the first roller 52. However, as described above, damage is not caused to the image in the sheet S because not only is the guide roller 61 rotated but also the guide member 60 can be retracted by the sheet S (FIG. 5B).

When the rear end of the sheet S passes through the first nip N1 after the sheet S is conveyed by the fixing and discharge roller 51 and the first roller 52, the sheet S is conveyed while nipped between the fixing and discharge roller 51 and the guide roller 61 of the guide member 60, and the sheet S is surely discharged to the discharge tray 56. At this point, it is assumed that the rear end of the discharged sheet S is curled while the guide roller 61 does not exist. In this case, the rear end of the sheet S is possibly stopped on the fixing and discharge roller to generate a discharge failure immediately after the sheet S passes through the first nip N1 between the fixing and discharge roller and the first roller. However, in the first embodiment, the sheet S is discharged on the downstream side of the first nip N1 in the rotating direction of the fixing and discharge roller 51 by cooperation of the fixing and discharge roller 51 and the guide roller 61 of the guide member 60. Accordingly, in the first embodiment, the sheet can surely be discharged.

In the case where the rear end of the sheet S cannot be discharged on the fixing and discharge roller 51 due to the curl or for some other reason as illustrated in FIG. 6, the intrusion of the subsequent sheet into the first nip N1 or the conveyance failure may be generated. However, the intrusion of the subsequent sheet into the first nip N1 or the conveyance failure is not generated, because the guide roller 61 of the guide member 60 can perform the nip conveyance of the sheet S on the downstream side of the highest portion of the fixing and discharge roller 51 in the sheet conveying direction.

As a result, even if the sheet S cannot be discharged on the fixing and discharge roller 51 due to the curl or for some reason, the sheet S can surely be conveyed to the discharge tray 56 to improve discharge performance.

Second Embodiment

A second embodiment of the invention will specifically be described with reference to the drawings. In the configuration of the second embodiment, the same component as the first embodiment is designated by the same numeral, and the description is neglected. Only characteristic portions of the second embodiment will be described below.

Figure 7:
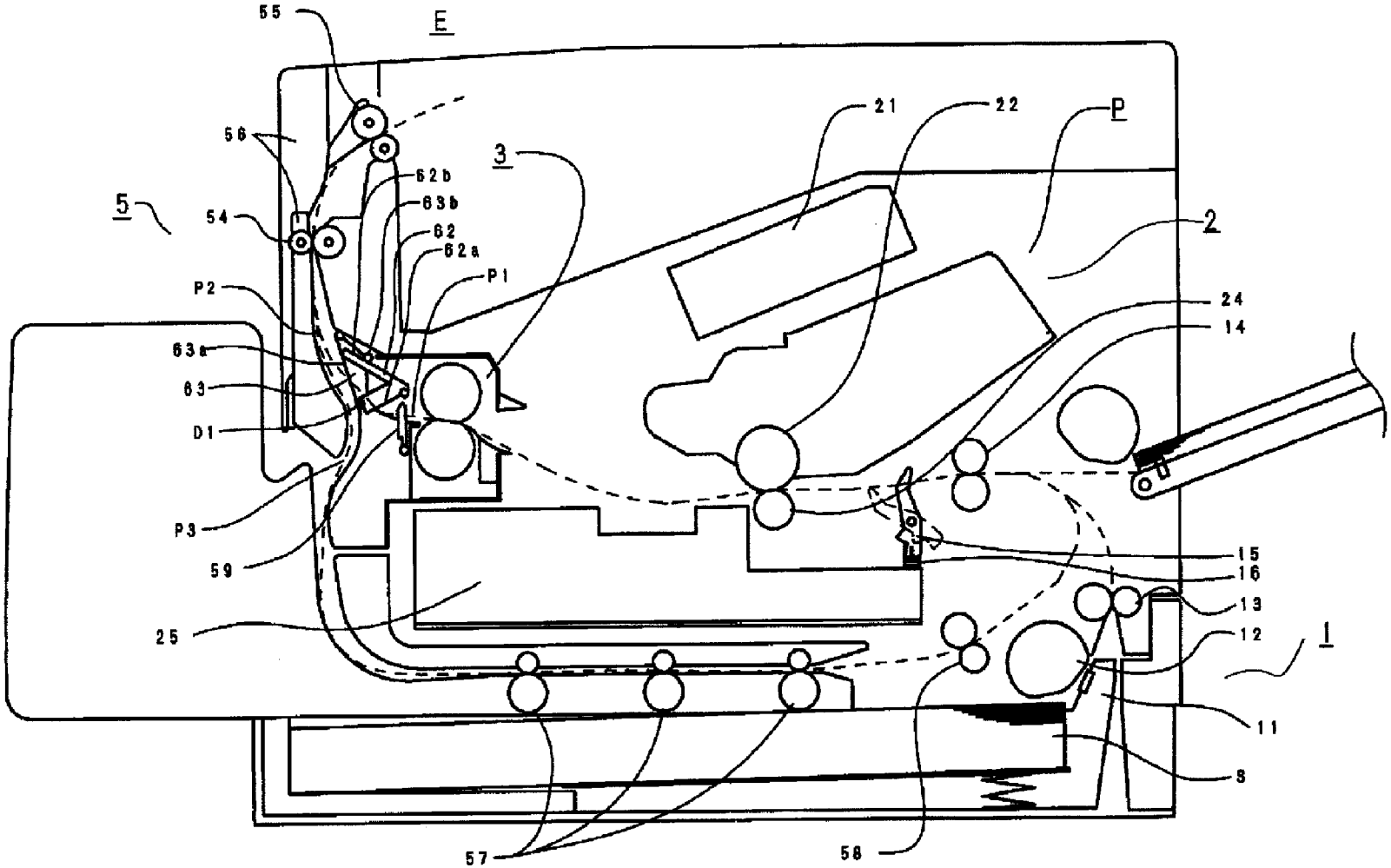
FIG. 7 is a sectional view illustrating a schematic configuration of an image forming apparatus including a sheet conveying apparatus according to a second embodiment of the invention.
Figure 8A:
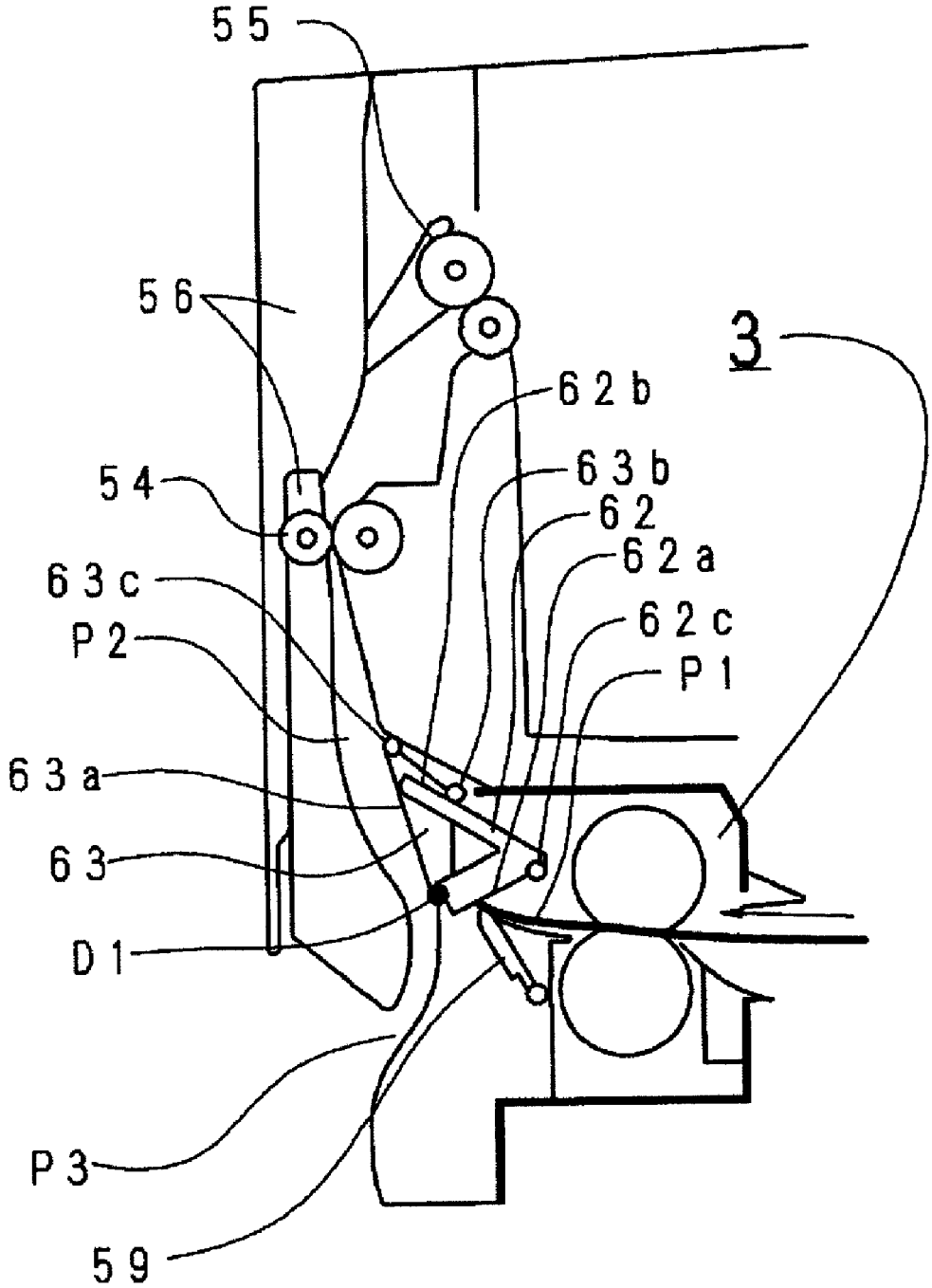
FIG. 8A is a schematic view illustrating a state of a guide unit when the sheet exists in the first conveying path during the reverse conveyance of the sheet in the second embodiment.
Figure 8B:
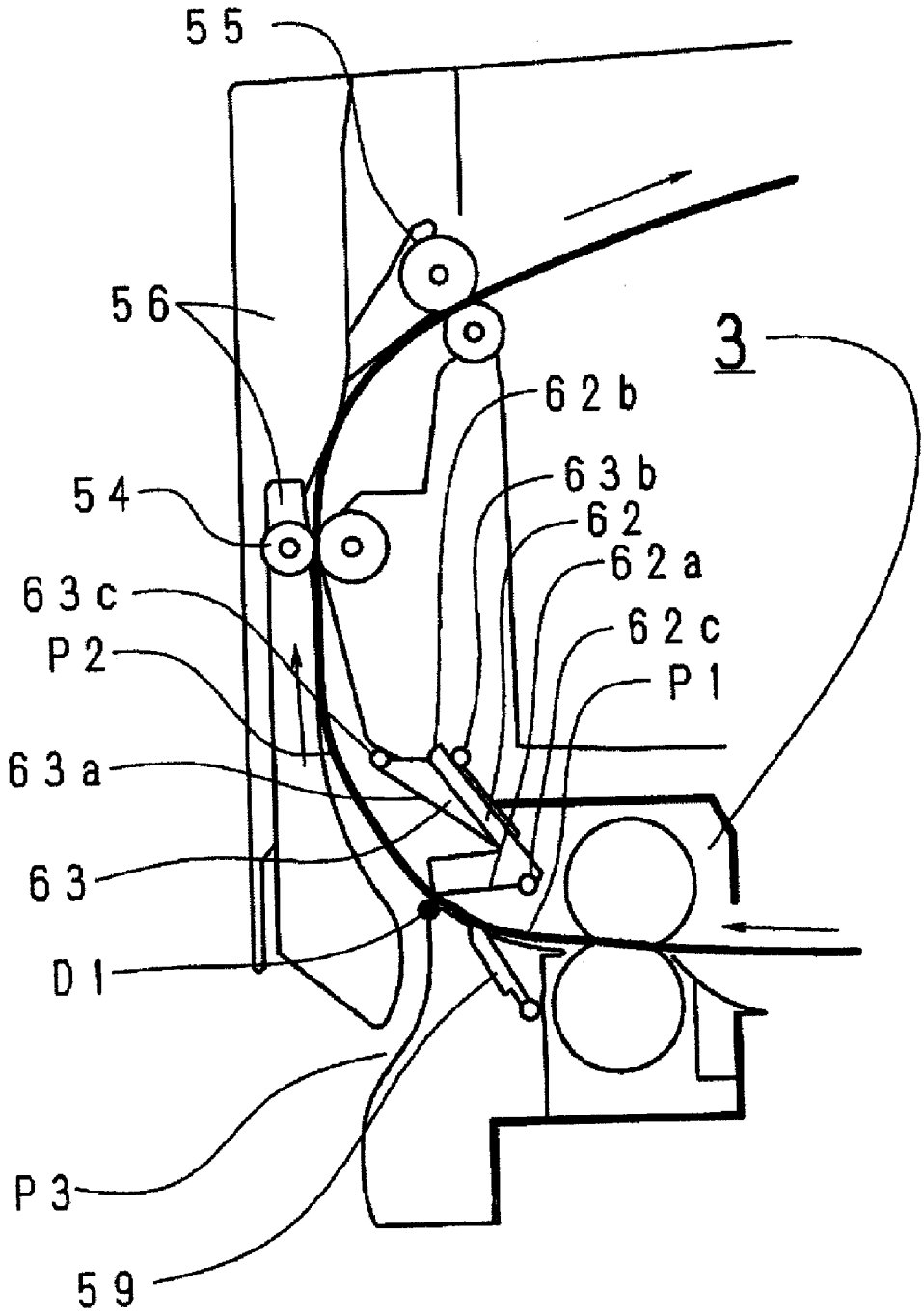
FIG. 8B is a schematic view illustrating a state of the guide unit when the sheet exists in the second conveying path during the reverse conveyance of the sheet in the second embodiment.
Figure 8C:
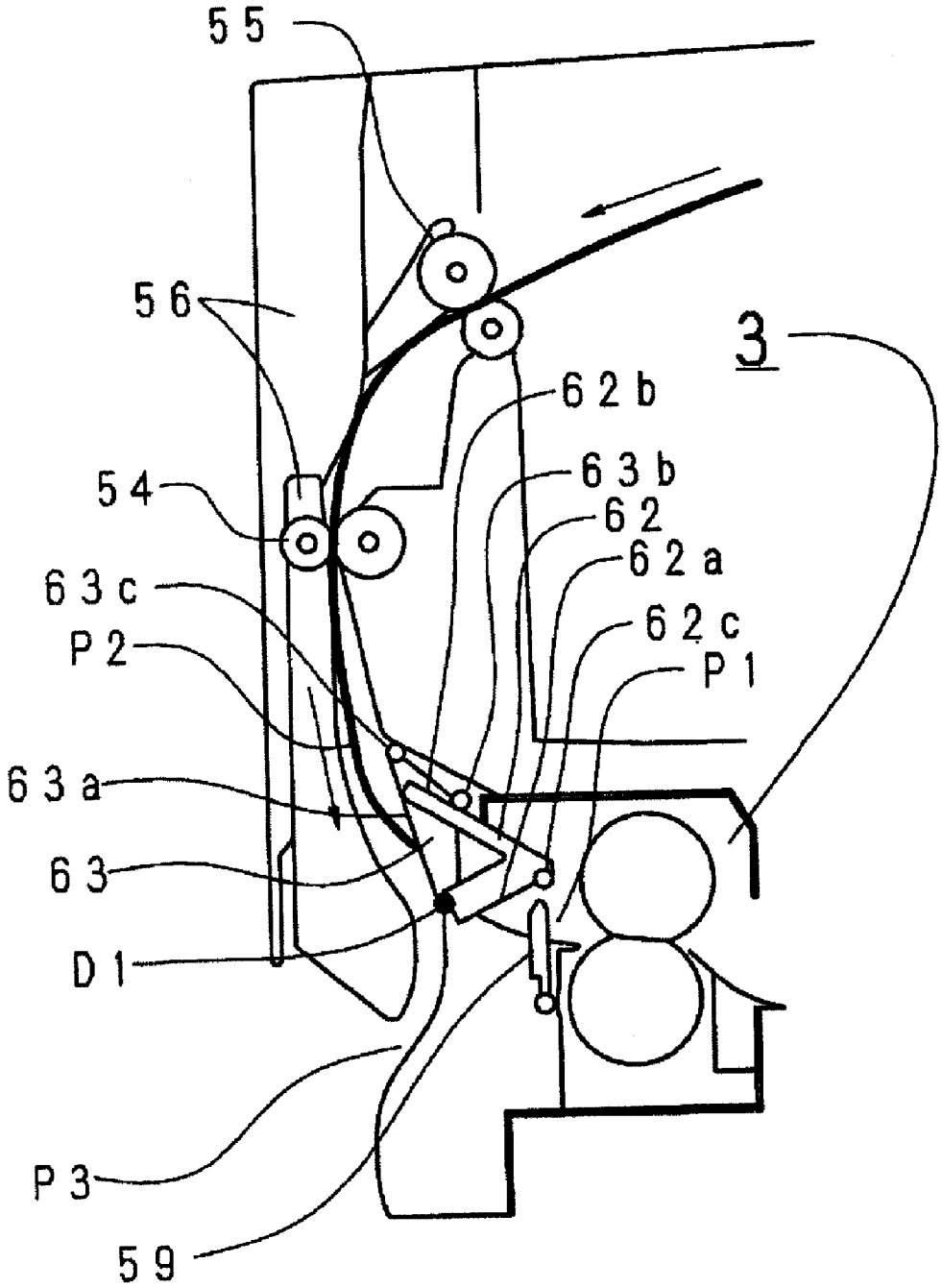
FIG. 8C is a schematic view illustrating a state of the guide unit when the sheet exists in the second conveying path during the reverse conveyance of the sheet in the second embodiment.
Figure 8D:
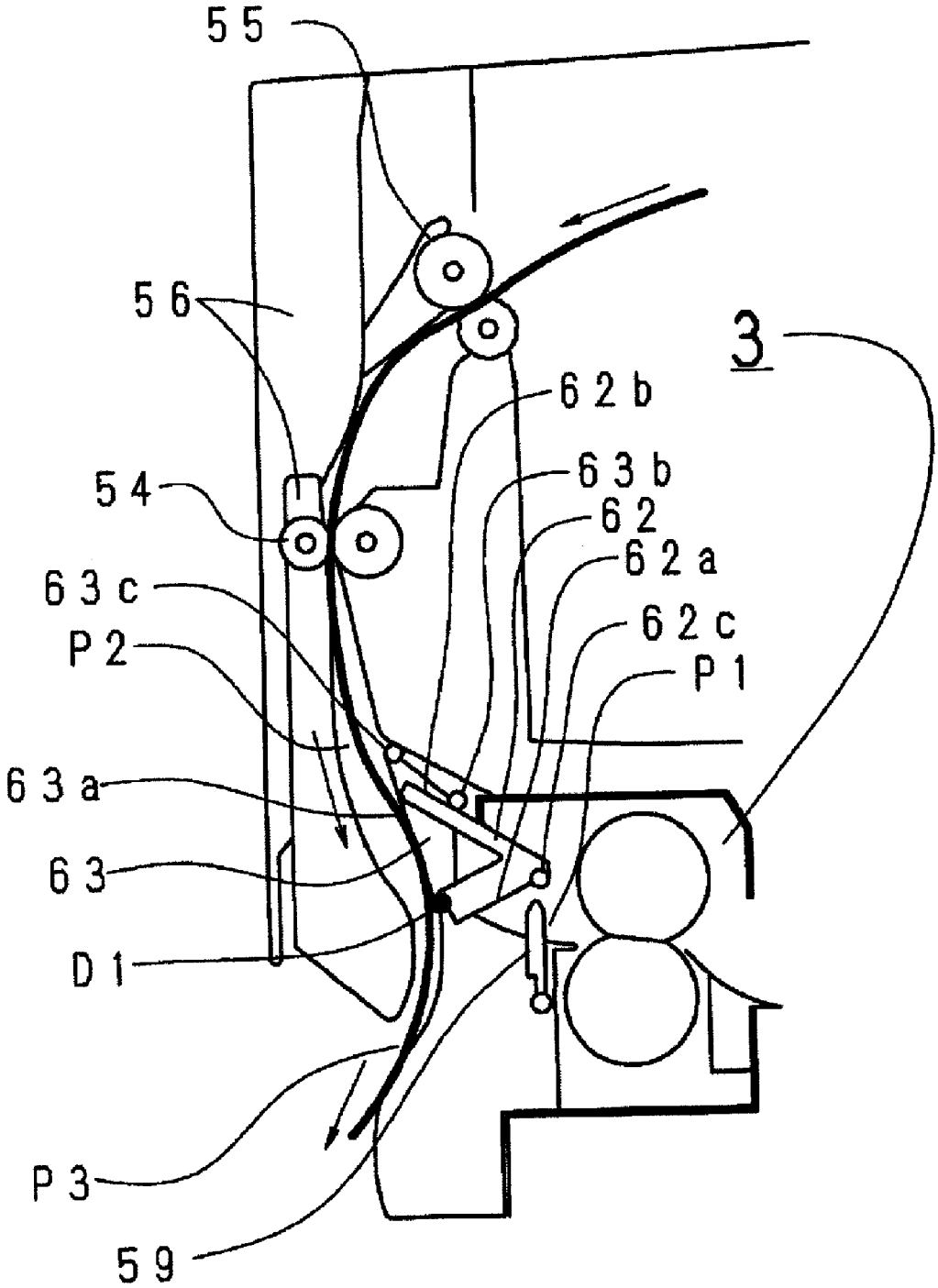
FIG. 8D is a schematic view illustrating a state of the guide unit when the sheet exists in the third conveying path during the reverse conveyance of the sheet in the second embodiment.
Figure 9:
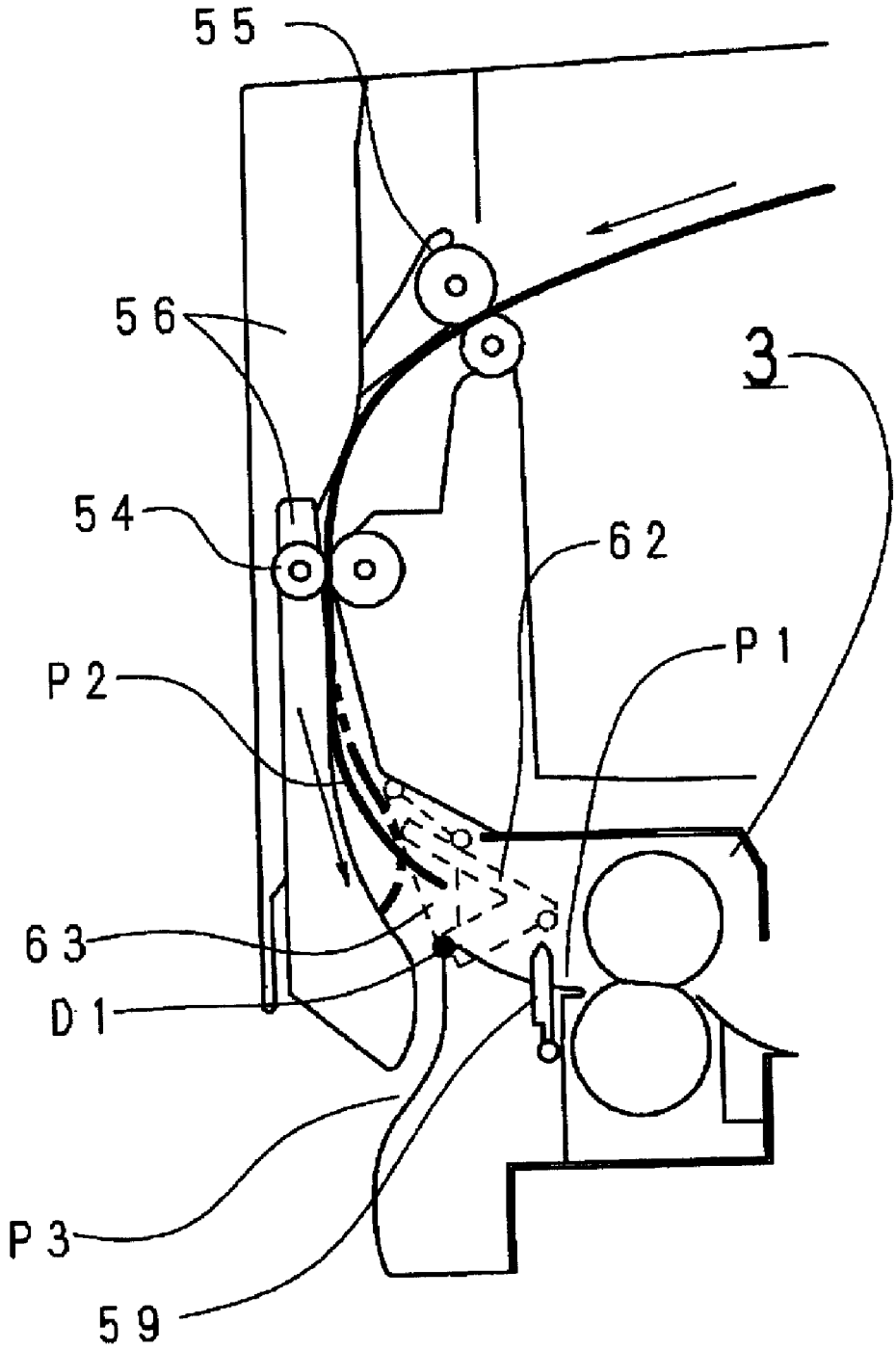
FIG. 9 is a schematic view illustrating a curled state during the reverse conveyance of the sheet.
Figure 10:
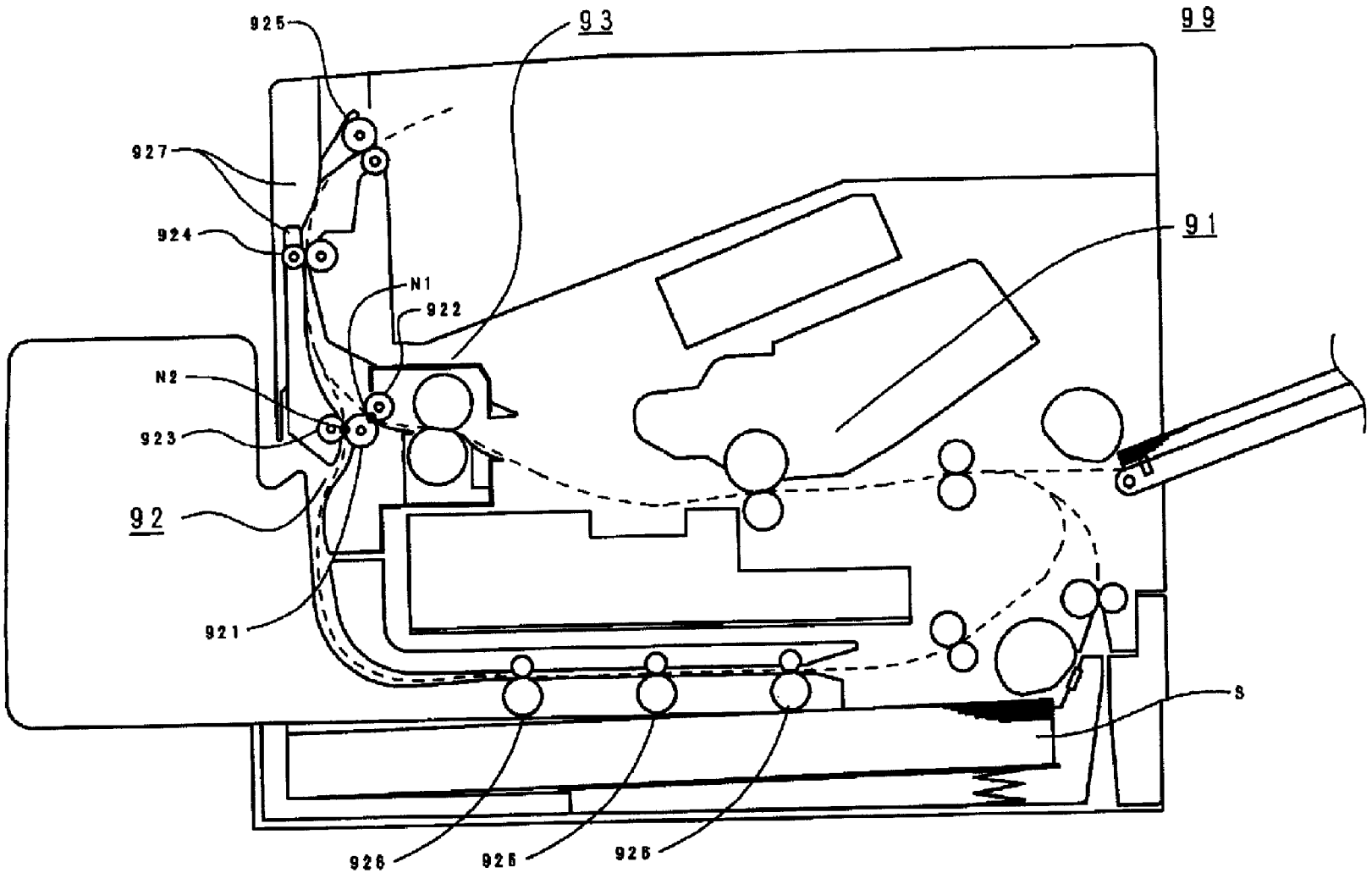
FIG. 10 is a sectional view illustrating a schematic configuration of an image forming apparatus including a conventional sheet conveying apparatus.

FIG. 7 is a sectional view illustrating a schematic configuration of an image forming apparatus including a sheet conveying apparatus according to a second embodiment of the invention, FIG. 8 is a schematic view illustrating an operation during the reverse conveyance of the sheet, and FIG. 9 is a schematic view illustrating a curled state during the reverse conveyance of the sheet.

(Configuration of Sheet Reverse Conveying Portion and Neighborhood Thereof)

The configuration of the sheet reverse conveying portion 5 and the neighborhood thereof will be described with reference to FIG. 7. The conveying path is provided to as follows: A first conveying path P1 is located from the image forming portion 2 to a conveying path branch position D1. A second conveying path P2 is located from the conveying path branch position D1 to the conveying path branch position D1 through the pair of discharge rollers 55. A third conveying path P3 is located from the conveying path branch position D1 to the pair of conveying rollers 58.

In the first conveying path P1, the fixing sensor 59 is provided on the downstream side of the fixing portion 3 in the sheet conveying direction to detect the presence of absence of the sheet S.

The guide unit includes a guide link 62 which is of a first guide member and a guide member 63 which is of a second guide member. The guide member 63 interrupts the first conveying path P1 to guide the sheet S to conveying path branch position D1 using a guide surface 63*a*. The guide link 62 is swingably supported, and a swing center 62*c* of the guide link 62 is located outside the first conveying path P1 and on the upstream side of the conveying path branch position D1 in the sheet conveying direction.

The front end portion of the sheet S presses the sheet front-end abutting surface 62*a* to rotate the guide link 62 clockwise, and a projection 63*b* of the guide member 63 is pressed by an arm portion 62*b*. This enables the guide member 63 to be rotated counterclockwise about the rotating center 63*c*. When the contact between the sheet S and the guide link 62 is eliminated, the guide link 62 is rotated counterclockwise by the self weight and the guide member 63 is rotated clockwise by the self weight.

The pair of reversing rollers 54 and pair of discharge rollers 55 located in the second conveying path P2 can normally and reversely be rotated to perform the discharge and reverse conveyance. Driving units (not shown) are also provided in the sheet reverse conveying portion 5 to normally or reversely rotate the pair of reversing rollers 54 and the pair of discharge rollers 55.

The conveying rollers 57 and 58 located in the third conveying path P3 convey the sheet S, in which the image is already formed in one of the surfaces, to the image forming portion 2 again.

(Reverse Conveyance of Sheet)

An operation during the reverse conveyance of the sheet in the configuration of the second embodiment will be described with reference to FIGS. 8 and 9.

In the duplex image formation of the sheet S, the sheet S is guided to the conveying path branch position D1 after conveyed through the first conveying path P1 to perform the image formation and the fixing to one of the surfaces. At this point, the fixing sensor 59 detects the front end of the sheet S. The front-end portion of the sheet S abuts on the sheet front-end abutting surface 62*a* of the guide link 62 to rotate the guide link 62 clockwise (FIG. 8A), thereby retracting the guide link 62 from the conveying path. At this point, the arm portion 62*b* of the guide link 62 presses the projection 63*b* of the guide member 63 to rotate the guide member 63 counterclockwise, thereby retracting the guide member 63 from the conveying path (FIG. 8B). As a result, the path is opened from the first conveying path P1 to the second conveying path P2. The swing center 62*c* of the guide link 62 is located on the upstream side of the conveying path branch position D1 in the sheet conveying direction, and only the force of the self weight is applied to the guide link 62. Therefore, the damage is not caused to the front end of the sheet S when the front end of the sheet S abuts on the sheet front-end abutting surface 62*a*.

In conveying the sheet S through the second conveying path P2, the sheet S abuts on the guide link 62 to retract the guide link 62 and the guide member 63.

The both the guide member 63 and the guide link 62 can be retracted, even if the conveying speed of the reversing roller 54 is faster than the conveying speed of the fixing portion 3 to eliminate the sheet looseness between the rollers.

Then, after a predetermined time elapse since the rear end of the sheet S passes through the fixing sensor 59, the reversal rotations of the pair of reversing rollers 54 and pair of discharge rollers 55 are started to guide the sheet S to the third conveying path P3. The guide member 63 is rotated clockwise to return to the initial position by the self weight after the rear end of the sheet S passes through the guide link 62. At this point, the guide member 63 blocks the first conveying path P1. At the same time, the guide member 63 is located at the position where the guide surface 63*a* guides the rear end of the sheet S to the third conveying path P3 (FIG. 8C).

Thus, because the reverse conveyance of the sheet S can be performed immediately after the rear end of the sheet S passes through the conveying path branch position D1, the conveying path can be shortened to achieve the downsizing and speed enhancement of the apparatus.

In the second embodiment, the reverse conveyance of the sheet is also controlled so as to be started at the position where the rear end of the sheet S does not exceed the lowermost position of the guide member 60, i.e., the position where the rear end of the sheet S and the guide surface 63*a* surely contact each other. In the case where the rear end of the sheet S is curled by the influence of the fixing portion 3 in starting the reverse conveyance as shown by the solid line or the alternate long and two short dashes line in FIG. 9, the guide surface 63*a* can apply the force to the end portion of the sheet S. The guide surface 63*a* guides the end portion of the sheet S to the downstream side of the conveying path branch position D1.

As a result, during the reverse conveyance, even if the sheet S curled toward the image forming surface side or the non-image forming surface side is conveyed to the side of the first conveying path P1, the conveyance failure is not generated. Therefore, the sheet is guided surely and smoothly to the third conveying path P3 (FIG. 8D), and the sheet can be conveyed to the image forming portion 2 again.

Obviously a configuration in which the force is applied to the guide link 62 and the guide member 63 by an elastic member, a configuration in which a rotating member is used in the abutting surface between the guide link 62 and the sheet S, a configuration in which a pair of rollers is used near the conveying path branch position D1 can be applied to the configuration of the second embodiment.

Other Embodiments

In the first and second embodiments, the laser beam printer is illustrated as the image forming apparatus by way of example. Furthermore, the invention can be applied to an apparatus in which the image forming process is utilized to form the image in a recording medium such as a recording sheet, an OHP sheet, and fabric. For example, the invention can clearly be applied to other pieces of image forming apparatus such as a copying machine, a printer (such as an LED printer, a laser beam printer, and an inkjet printer), a facsimile, and a word processor.

Additionally, the invention can clearly be applied to not only the image forming apparatus but also an apparatus the switch of the sheet conveying path or the reverse conveyance of the sheet is performed using the sheet conveying apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from the prior Japanese Patent Application No. 2007-146375 filed on Jun. 1, 2007 the entire contents of which are incorporated by reference herein.

What is claimed is:

1. A sheet conveying apparatus, which conveys a sheet on which an image is formed on a first surface by an image forming portion toward the image forming portion again for forming an image on a second surface of the sheet, comprising:

a first conveying path configured to guide the sheet on which the image is formed on the first surface;

a sheet reverse conveying portion which conveys a sheet, which has been guided by the first conveying path, in a first direction, and thereafter conveys the sheet in a second direction opposite the first direction;

a second conveying path configured to guide the sheet conveyed by the reverse conveying portion in the first direction and the second direction;

a third conveying path configured to guide the sheet conveyed from the second conveying path in the second direction by the sheet reverse conveying portion, the second conveying path conveying the sheet to the image forming portion for forming the image on the second surface; and a guide portion configured to guide the conveyed sheet, the guide portion being movable and being provided between the first conveying path and the second conveying path, the guide portion contacting with an identical surface side of the sheet when the sheet is guided from the first conveying path to the second conveying path and when the sheet is guided from the second conveying path to the third conveying path, wherein the guide portion is moved to a position where the guide portion guides the sheet to the third conveying path while blocking between the second conveying path and the first conveying path such that the sheet can not intrude from the second conveying path into the first conveying path when the sheet conveyed by the sheet reverse conveying portion is conveyed in the second direction, and the guide portion is moved to form a route connecting the first conveyance path and the second conveyance path by a sheet which is conveyed in the first conveyance path toward the second conveyance path.

2. The sheet conveying apparatus according to claim 1, wherein the sheet reverse conveying portion reverses a sheet conveying direction from the first direction to the second direction while the sheet and the guide portion contact each other.

3. The sheet conveying apparatus according to claim 1, further comprising:

a first rotating member which is rotated in a predetermined direction;

a second rotating member which abuts on the first rotating member, the second rotating member and the first rotating member conveying the sheet toward the sheet reverse conveying portion while nipping the sheet therebetween; and a third rotating member which abuts on the first rotating member, the third rotating member and the first rotating member conveying the sheet conveyed in the second direction by the sheet reverse direction toward the third conveying path while nipping the sheet therebetween.

4. The sheet conveying apparatus according to claim 3, wherein at least a part of the second conveying path can be opened, the sheet can be discharged to an outside from the opened second conveying path by the first rotating member and the second rotating member, and the sheet is passed between the guide portion and the first rotating member convey on a downstream side of an abutment position between the first rotating member and the second rotating member in a sheet conveying direction, when the second conveying path is opened.

5. The sheet conveying apparatus according to claim 1, wherein the guide portion is moved to bias an end portion of the sheet to the third conveying path side when the end portion of the sheet passes through the first conveying path.

6. An image forming apparatus including an image forming portion which forms an image on a sheet, the sheet in which the image is formed on a first surface by the image forming portion can be conveyed to the image forming portion again, to formed on a second surface of the sheet, the image forming apparatus comprising:

a sheet conveying portion which conveys the sheet;

a first conveying path configured to guide the sheet conveyed by the sheet conveying portion, the image being formed on the first surface of the sheet;

a sheet reverse conveying portion which conveys a sheet, which has been guided by the first conveying path, in a first direction, and thereafter conveys the sheet in a second direction opposite the first direction;

a second conveying path configured to guide the sheet conveyed by the reverse conveying portion in the first direction and the second direction;

a third conveying path configured to guide the sheet conveyed from the second conveying path in the second direction by the sheet reverse conveying portion so as to guide the sheet toward the image forming portion again; and a guide portion configured to guide the sheet, the guide portion being movable and provided between the first conveying path and the second conveying path, the guide portion contacting with an identical surface side of the sheet when the sheet is guided from the first conveying path to the second conveying path and when the sheet is guided from the second conveying path to the third conveying path, wherein the guide portion is moved to a position where the guide portion guides the sheet to the third conveying path while blocking between the second conveying path and the first conveying path such that the sheet can not intrude from the second conveying path into the first conveying path, when the sheet conveyed by the sheet reverse conveying portion is conveyed in the second direction, and the guide portion is moved to form a route connecting the first conveyance path and the second conveyance path by a sheet which is conveyed in the first conveyance path toward the second conveyance path.

7. A sheet conveying apparatus, which conveys a sheet on which an image is formed on a first surface by an image forming portion toward the image forming portion again for forming an image on a second surface of the sheet, comprising:

a first rotating member which conveys a sheet on which is formed the image on the first surface;

a second rotating member which conveys the sheet while nipping the sheet by a first nip formed between the first rotating member and the second rotating member;

a third rotating member which conveys the sheet while nipping the sheet by a second nip formed between the first rotating member and the third rotating member for conveying the sheet toward the image forming portion to form an image on the second surface after conveying the sheet by the second nip;

a sheet reverse conveying portion to which the sheet conveyed while nipped by the first nip is guided, wherein the sheet reverse conveying portion conveys the sheet in a first direction away from the first nip and thereafter conveys the sheet in a second direction toward the second nip;

a guide portion which is movably provided between the second nip and the sheet reverse conveying portion, the guide portion contacting with an identical surface side of the sheet when the sheet is conveyed by the first nip to the reverse conveying portion and when the sheet is conveyed by the reverse conveying portion to the second nip, wherein the guide portion can be in a first position where the guide portion guides the sheet to the second nip while blocking the first nip such that the sheet conveyed by the sheet reverse conveying portion can not intrude into the first nip and the guide portion is moved to form a route connecting the first conveyance path and the second conveyance path by a sheet which is nipped the first nip to be conveyed toward the sheet reverse conveying portion.

8. The sheet conveying apparatus according to claim 7, wherein the sheet reverse conveying portion reverses the sheet from the first direction to the second direction while the sheet and the guide portion contact each other.

9. The sheet conveying apparatus according to claim 7, further comprising a conveying path provided between the first nip and the sheet reverse conveying portion, wherein the conveying path can be opened, the sheet can be discharged to an outside from the opened conveying path by the first rotating member and the second rotating member, and the sheet is passed between the guide portion and the first rotating member on a downstream side of an abutment position between the first rotating member and the second rotating member in a sheet conveying direction, when the second conveying path is opened.

* * * * *